US012480735B2

(12) United States Patent
Yehle

(10) Patent No.: US 12,480,735 B2
(45) Date of Patent: Nov. 25, 2025

(54) COCKING SYSTEM FOR A CROSSBOW

(71) Applicant: Ravin Crossbows, LLC, Superior, WI (US)

(72) Inventor: Craig Yehle, Winona, MN (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 17/199,000

(22) Filed: Mar. 11, 2021

(65) Prior Publication Data

US 2021/0222987 A1 Jul. 22, 2021

Related U.S. Application Data

(63) Continuation of application No. 16/237,062, filed on Dec. 31, 2018, now abandoned, which is a continuation of application No. 15/782,259, filed on Oct. 12, 2017, now Pat. No. 10,209,026.

(60) Provisional application No. 62/989,023, filed on Mar. 13, 2020, provisional application No. 62/441,618, filed on Jan. 3, 2017.

(51) Int. Cl.

| | |
|---|---|
| ***F41B 5/10*** | (2006.01) |
| ***F41B 5/06*** | (2006.01) |
| ***F41B 5/12*** | (2006.01) |
| ***F41B 5/14*** | (2006.01) |

(52) U.S. Cl.

CPC ..... *F41B 5/105* (2013.01); *F41B 5/066* (2013.01); *F41B 5/10* (2013.01); *F41B 5/123* (2013.01); *F41B 5/1411* (2013.01); *F41B 5/143* (2013.01); *F41B 5/1469* (2013.01)

(58) Field of Classification Search

CPC ..... F41B 5/1469; F41B 5/12; F41B 5/1411; F41B 3/005; F41B 7/006; F41B 5/105; F41B 5/066; F41B 5/10; F41B 5/123; F41B 5/143

See application file for complete search history.

(56) References Cited

U.S. PATENT DOCUMENTS 1,356,052 A * 10/1920 Duchesne ..... B62L 5/14 192/217.7
1,866,926 A 7/1932 Colby
2,092,361 A 9/1937 Shirn
(Continued)

FOREIGN PATENT DOCUMENTS

DE 102004034730 2/2006
EP 3 734 217 A1 11/2020
(Continued)

OTHER PUBLICATIONS

Office Action for U.S. Appl. No. 16/281,239, mailed on Mar. 16, 2021, Yehle, "Reduced Length Crossbow", 21 Pages.
(Continued)

*Primary Examiner* — Eugene L Kim
*Assistant Examiner* — Amir A Klayman
(74) *Attorney, Agent, or Firm* — Foley & Lardner LLP

(57) ABSTRACT

A crossbow including pulleys rotatably attached to a center rail of the crossbow. Power cables of the crossbow connect the limbs of the crossbow to the pulleys. The draw string is enclosed in a safety cover. The crossbow includes a cocking system that translates a string carrier along the center rail to cock and de-cock the crossbow.

18 Claims, 24 Drawing Sheets

(56) References Cited

U.S. PATENT DOCUMENTS 2,396,128 A * 3/1946 Robaczynski ..... B24B 47/04 74/27
2,667,808 A * 2/1954 Hart ..... G03B 19/18 250/580
2,679,706 A 6/1954 Windle
2,815,838 A 12/1957 Dodge
2,918,050 A 12/1959 Kopman
3,043,287 A 7/1962 Nelson
3,108,670 A 10/1963 Habicht
3,476,226 A 11/1969 Massey
3,537,554 A 11/1970 Cowles et al.
3,625,324 A * 12/1971 Scharf ..... F16D 41/067 192/45.008
3,731,774 A * 5/1973 Kitchin ..... F16D 41/067 192/45.007
3,809,048 A 5/1974 Handford
3,812,833 A 5/1974 Skillern
3,851,638 A 12/1974 Alexander
3,854,467 A 12/1974 Hofmeister
4,078,538 A 3/1978 Shepley
4,130,191 A * 12/1978 Judd ..... F16D 41/07 192/41 A
4,169,456 A 10/1979 Van House
4,187,826 A 2/1980 Killian
4,241,715 A 12/1980 Jennings
4,287,867 A 9/1981 Islas
4,305,588 A 12/1981 Dodge
4,324,221 A * 4/1982 Peck ..... F41B 5/143 124/44.5
4,338,910 A 7/1982 Darlington
4,340,025 A 7/1982 Caldwell
4,368,718 A 1/1983 Simonds et al.
4,401,097 A 8/1983 Simonds et al.
4,411,248 A 10/1983 Kivenson
4,457,288 A 7/1984 Ricord
4,478,202 A * 10/1984 Anderson ..... F41B 5/10 124/32
4,478,203 A 10/1984 Hayes
4,512,326 A 4/1985 Jarrett
4,562,824 A 1/1986 Jennings
4,566,567 A 1/1986 Miyatake
4,594,994 A 6/1986 Williams
4,660,698 A 4/1987 Miura
4,662,345 A 5/1987 Stephens
4,686,955 A 8/1987 Larson
4,688,539 A 8/1987 Lawrence
4,706,965 A 11/1987 Schaar
4,719,897 A 1/1988 Gaudreau
4,722,318 A 2/1988 Yankey
4,748,962 A 6/1988 Larson
4,756,296 A 7/1988 Darlington
4,766,874 A 8/1988 Nishioka
4,774,927 A 10/1988 Larson
4,781,168 A 11/1988 Lester
4,796,598 A 1/1989 Jones
4,903,677 A 2/1990 Colley et al.
4,926,574 A 5/1990 Rieger
4,926,833 A 5/1990 Darlington
5,020,507 A 6/1991 Larson
5,024,206 A 6/1991 Lester
5,031,601 A * 7/1991 Gunter ..... F41B 5/143 124/44.5
5,119,797 A 6/1992 Anderson
5,253,633 A * 10/1993 Sisko ..... F41B 5/1438 124/44.5
5,353,777 A 10/1994 Fincher
5,417,439 A 5/1995 Bickel
5,485,905 A 1/1996 Rader
5,649,521 A 7/1997 King
5,678,528 A 10/1997 Hadley
5,749,348 A 5/1998 Oviedo-Reyes
5,791,322 A 8/1998 McPherson
5,823,172 A * 10/1998 Suggitt ..... F41B 5/12 124/25
5,934,265 A 8/1999 Darlington
5,950,609 A 9/1999 Thielen et al.
5,967,132 A 10/1999 Loomis
6,035,840 A 3/2000 McPherson
6,095,128 A 8/2000 Bednar
6,098,607 A 8/2000 Strother
6,205,990 B1 3/2001 Adkins
6,273,078 B1 8/2001 Schwesinger
6,364,499 B1 4/2002 Jones
6,390,642 B1 5/2002 Simonton
6,470,870 B1 10/2002 Schaar
6,474,324 B1 11/2002 Despart et al.
6,561,175 B1 5/2003 Tidmore
6,698,413 B1 3/2004 Ecklund
6,705,304 B1 3/2004 Pauluhn
6,736,123 B1 5/2004 Summers et al.
6,761,503 B2 7/2004 Breese
6,769,525 B2 8/2004 Pascoe
6,792,930 B1 9/2004 Kronengold et al.
6,792,931 B1 9/2004 Schaar
6,802,304 B1 10/2004 Chang
6,913,007 B2 7/2005 Bednar
6,990,970 B1 1/2006 Darlington
7,017,568 B1 3/2006 Smith
7,143,757 B1 12/2006 Cooper
7,189,170 B1 3/2007 Korsa et al.
7,204,242 B2 4/2007 Dziekan
7,305,979 B1 12/2007 Yehle
7,328,693 B2 2/2008 Kempf
7,441,555 B1 10/2008 Larson
7,578,289 B2 * 8/2009 Norkus ..... F41B 5/10 124/44.5
7,588,022 B2 9/2009 Chang
7,686,714 B2 3/2010 Smith et al.
7,708,001 B2 5/2010 Kempf
7,770,567 B1 * 8/2010 Yehle ..... F41A 17/46 124/40
7,784,453 B1 8/2010 Yehle
7,823,572 B2 11/2010 Anderson
7,836,871 B2 11/2010 Kempf
7,891,348 B2 2/2011 Colley
7,971,582 B1 7/2011 Larson
8,020,544 B2 9/2011 Mcpherson et al.
8,069,848 B1 12/2011 Larson
8,136,514 B2 3/2012 Howard et al.
8,156,928 B1 4/2012 Blahnik
8,181,638 B1 5/2012 Yehle
8,191,541 B2 6/2012 Shaffer et al.
8,205,607 B1 6/2012 Darlington
8,297,267 B2 10/2012 Popov et al.
8,375,928 B1 * 2/2013 Bednar ..... F41B 5/1469 124/25
8,387,603 B2 3/2013 Darlington
8,448,765 B2 5/2013 Lee
8,469,013 B1 6/2013 Obteshka et al.
8,485,170 B1 7/2013 Prior
8,578,917 B2 * 11/2013 Bednar ..... F41B 5/1469 124/25
8,578,918 B1 11/2013 Islas
8,651,095 B2 2/2014 Islas
8,671,923 B2 3/2014 Goff et al.
8,683,989 B1 4/2014 Mcpherson
8,689,774 B1 4/2014 Ritz
8,813,735 B2 8/2014 Biafore et al.
8,833,349 B2 9/2014 Park
8,875,687 B1 * 11/2014 Huang ..... F41B 5/143 124/44.5
8,881,714 B1 11/2014 Cooper
8,899,217 B2 12/2014 Islas
8,950,385 B1 2/2015 Khoshnood
8,997,728 B2 * 4/2015 Popov ..... F41B 5/0094 124/25.6
9,010,308 B1 4/2015 Hyde et al.
9,052,154 B1 * 6/2015 Prior ..... F41B 5/12
9,121,658 B1 9/2015 Darlington
9,140,516 B1 9/2015 Hyde
9,151,580 B2 10/2015 Pedersen
9,225,754 B2 12/2015 Boysen et al.
9,243,861 B1 1/2016 Kempf et al.

(56) References Cited

U.S. PATENT DOCUMENTS 9,255,756 B1* 2/2016 Wu ..... F41B 5/123
9,255,764 B2 2/2016 Park
9,297,604 B1* 3/2016 Sidebottom ..... F41B 5/105
9,303,944 B2 4/2016 Barber
9,341,432 B1* 5/2016 Wohleb ..... F41B 5/1469
9,341,434 B2* 5/2016 McPherson ..... F41B 5/123
9,354,015 B2 5/2016 Yehle
9,377,267 B1* 6/2016 Kempf ..... F41B 5/105
9,389,041 B2 7/2016 Novikov
9,423,202 B1 8/2016 Obteshka et al.
9,423,203 B2 8/2016 Simonds
9,441,907 B1 9/2016 Obteshka
9,441,925 B1 9/2016 Palomaki et al.
9,453,698 B1* 9/2016 Grace ..... F41B 5/1411
9,459,067 B1 10/2016 Mason
9,476,666 B1 10/2016 Larner
9,494,379 B2 11/2016 Yehle
9,500,433 B2 11/2016 Mcpherson
9,506,714 B1 11/2016 Eacker et al.
9,506,715 B2 11/2016 Hughes
9,513,080 B1* 12/2016 Kempf ..... F41B 5/1411
9,702,671 B2 7/2017 Minica
9,719,749 B1* 8/2017 Prior ..... F41B 3/005
9,726,454 B2 8/2017 McPherson et al.
9,746,276 B2 8/2017 Hughes et al.
9,752,842 B1 9/2017 Huang
9,757,509 B2 9/2017 De La Huerga
9,759,509 B1 9/2017 Kempf et al.
9,829,268 B1 11/2017 Kempf et al.
9,958,232 B1* 5/2018 Egerdee ..... F41B 5/1403
9,989,329 B2 6/2018 Kelly
10,012,468 B1 7/2018 Kempf et al.
10,041,755 B1 8/2018 Langdon et al.
10,048,036 B1 8/2018 Kempf et al.
10,139,189 B1 11/2018 Isenhower et al.
10,190,841 B2 1/2019 Laurence
10,240,890 B2 3/2019 Trpkovski
10,267,589 B1 4/2019 Snook
10,295,295 B2 5/2019 Shaffer et al.
10,295,299 B2 5/2019 Vergara
10,359,254 B1* 7/2019 Kempf ..... F41B 5/12
10,393,470 B1* 8/2019 Popov ..... F41B 5/105
10,401,117 B1 9/2019 Rowzie, Jr. et al.
10,421,637 B1 9/2019 Huang
10,473,417 B1 11/2019 Peacemaker et al.
10,473,418 B2 11/2019 Shaffer et al.
10,495,404 B2 12/2019 Shaffer et al.
10,533,822 B1 1/2020 Popov
10,612,884 B2 4/2020 Walthert
10,627,185 B2 4/2020 Marriott et al.
10,634,447 B2 4/2020 Smith et al.
10,655,942 B2 5/2020 Schellinger
10,677,558 B2 6/2020 McPherson et al.
10,704,873 B1 7/2020 Minica et al.
10,767,956 B2 9/2020 Popov
10,774,583 B1 9/2020 Chuang
10,859,338 B2 12/2020 Polanich
10,900,738 B1 1/2021 Hensel et al.
10,907,925 B2 2/2021 Shaffer et al.
10,948,257 B1 3/2021 Huang et al.
10,969,192 B1 4/2021 Gallops et al.
10,976,142 B1 4/2021 Hilt
11,015,892 B1 5/2021 Jessup et al.
11,022,398 B1 6/2021 Kempf et al.
11,041,689 B2 6/2021 Mcpherson et al.
11,067,357 B1 7/2021 Chu et al.
11,098,973 B2 8/2021 Walthert
11,105,592 B1 8/2021 Keeney et al.
11,112,205 B1 9/2021 Kempf et al.
11,156,429 B1 10/2021 Kempf et al.
11,236,962 B2 2/2022 Mcpherson et al.
11,262,152 B2 3/2022 Thalberg
11,262,153 B1 3/2022 Mcneil
11,268,780 B2 3/2022 Stanziale
11,268,781 B1 3/2022 Kempf et al.
11,313,640 B2* 4/2022 Langley ..... F41B 5/1411
11,320,231 B2 5/2022 Williams
11,346,632 B1 5/2022 Kempf et al.
11,371,795 B1 6/2022 Kempf et al.
11,378,350 B1 7/2022 Kempf et al.
11,609,061 B2 3/2023 Walthert
2004/0194771 A1* 10/2004 Malucelli ..... F41B 5/12 124/25
2006/0086346 A1 4/2006 Middleton
2006/0169258 A1 8/2006 Chang
2007/0044782 A1 3/2007 Norkus
2008/0141989 A1 6/2008 Ogawa
2008/0168969 A1 7/2008 Kempf
2008/0251058 A1 10/2008 Colley
2009/0032002 A1 2/2009 Howard et al.
2009/0064978 A1 3/2009 Matasic et al.
2009/0101126 A1 4/2009 Anderson
2009/0223500 A1 9/2009 Stanziale
2009/0277435 A1 11/2009 Pestrue
2009/0314271 A1 12/2009 Ribi
2010/0000504 A1 1/2010 Trpkovski
2010/0170487 A1 7/2010 Kronengold et al.
2010/0170488 A1 7/2010 Rasor et al.
2010/0170489 A1 7/2010 Shepley et al.
2010/0206284 A1 8/2010 Popov et al.
2010/0224176 A1 9/2010 Kaylan
2010/0269679 A1 10/2010 Fisk et al.
2010/0269808 A1 10/2010 Evans
2011/0030666 A1 2/2011 Darlington
2011/0041820 A1 2/2011 Stanziale
2011/0203561 A1 8/2011 Shaffer et al.
2011/0308508 A1 12/2011 Islas
2012/0000452 A1 1/2012 Mcpherson et al.
2012/0100942 A1 4/2012 Minica
2012/0125302 A1 5/2012 Stanziale
2012/0210990 A1 8/2012 Park
2012/0298087 A1 11/2012 Trpkovski
2012/0304974 A1 12/2012 Goff et al.
2012/0312287 A1 12/2012 Park
2013/0213371 A1 8/2013 Biafore
2013/0267359 A1 10/2013 Pedersen
2013/0312284 A1 11/2013 Berend et al.
2014/0031153 A1 1/2014 Boretto
2014/0174419 A1 6/2014 McPherson et al.
2014/0190460 A1 7/2014 Langley
2014/0261357 A1 9/2014 Mcpherson
2014/0261358 A1 9/2014 Pulkrabek et al.
2014/0261360 A1 9/2014 Pulkrabek et al.
2014/0283802 A1 9/2014 Breslin
2014/0360480 A1 12/2014 Koch
2015/0040883 A1 2/2015 McPherson et al.
2015/0128923 A1 5/2015 Houle
2015/0168093 A1 6/2015 Yehle
2015/0209821 A1 7/2015 Pfahnl et al.
2015/0233664 A1 8/2015 McPherson
2015/0285581 A1 10/2015 Chang
2015/0285582 A1 10/2015 Chang
2015/0354916 A1 12/2015 Polanich et al.
2016/0195361 A1 7/2016 Barnett
2016/0238339 A1 8/2016 Mitchell
2016/0265866 A1* 9/2016 Carroll, Jr. ..... F41B 5/12
2017/0038175 A1 2/2017 Bamett
2017/0115090 A1 4/2017 Bofill
2017/0131059 A1 5/2017 McPherson et al.
2017/0138690 A1 5/2017 Serviss
2017/0328353 A1 11/2017 Polanich
2017/0328669 A1 11/2017 McPherson et al.
2018/0202748 A1 7/2018 Shaffer et al.
2018/0216908 A1 8/2018 Ady
2018/0266786 A1 9/2018 McPherson et al.
2019/0011214 A1 1/2019 Bartels
2019/0033033 A1 1/2019 Vergara
2019/0120587 A1 4/2019 Hanson
2019/0162500 A1 5/2019 Bednar et al.
2019/0186863 A1 6/2019 Yehle
2019/0186865 A1 6/2019 Pulkrabek et al.
2019/0242670 A1 8/2019 Smith et al.
2019/0368837 A1 12/2019 Mcpherson
2020/0011632 A1 1/2020 Chang

(56) References Cited

U.S. PATENT DOCUMENTS

| | | | |
|---|---|---|---|
| 2020/0011634 | A1 | 1/2020 | Walthert |
| 2020/0025504 | A1 | 1/2020 | McPherson |
| 2020/0103199 | A1 | 4/2020 | Shaffer et al. |
| 2020/0408482 | A1 | 12/2020 | Yehle |
| 2021/0018293 | A9 | 1/2021 | Yehle |
| 2021/0048268 | A1 | 2/2021 | Trpkovski |
| 2021/0088305 | A1 | 3/2021 | Yehle |
| 2021/0247161 | A1 | 8/2021 | Stanziale |
| 2021/0270560 | A1 | 9/2021 | Yehle |
| 2022/0018626 | A1 | 1/2022 | Nishihira |
| 2022/0026170 | A1 | 1/2022 | Walthert |
| 2022/0136797 | A1 | 5/2022 | Haas et al. |

FOREIGN PATENT DOCUMENTS

| | | | |
|---|---|---|---|
| KR | 20100039306 | A | 4/2010 |
| KR | 20110058756 | A | 6/2011 |
| KR | 20110063407 | A | 6/2011 |
| WO | WO-2011/141771 | A1 | 11/2011 |
| WO | WO-2011/158062 | A1 | 12/2011 |
| WO | WO-2012/153166 | A1 | 11/2012 |
| WO | WO2017123687 | | 7/2017 |

OTHER PUBLICATIONS

Office Action for U.S. Appl. No. 16/021,475, mailed on May 14, 2021, Yele, "Silent Cocking System for a Crossbow", 39 Pages.
Office Action for U.S. Appl. No. 15/673,784, mailed on Mar. 10, 2022, Yehle, "Arrow Assembly for a Crossbow and Method of Using Same", 30 pages.
Office Action fro U.S. Appl. No. 16/021,475, mailed on Dec. 15, 2021, Yehle, "Silent Cocking System for a Crossbow", 30 Pages.
Office Action for U.S. Appl. No. 16/927,554, mailed on Dec. 21, 2021, Yehle, "Crossbow", 11 Pages.
Office Action for U.S. Appl. No. 16/021,475, mailed on Dec. 8, 2020, Yehle, "Silent Cocking System for a Crossbow", 22 Pages.
Office Action for U.S. Appl. No. 15/673,784, mailed on Dec. 21, 2020, Yehle, "Arrow Assembly for a Crossbow and Method of Using Same", 22 Pages.
Final Office Action dated Feb. 4, 2020 for U.S. Appl. No. 16/237,062 "Crossbow with Pulleys that Rotate Around Stationary Axes" Yehle, 31 pages.
Final Office Action dated Feb. 4, 2020 for U.S. Appl. No. 16/281,239 "Reduced Length Crossbow" Yehle, 24 pages.
Office Action for U.S. Appl. No. 16/258,982, mailed on Mar. 20, 2020, Yehle, "Crossbow With Cabling System", 6 pages.
Office Action for U.S. Appl. No. 16/021,475, mailed on Mar. 6, 2020, Yehle, "Silent Cocking System for a Crossbow ", 23 pages.
Office Action for U.S. Appl. No. 15/673,784, mailed on Jun. 8, 2020, Yehle, "Arrow Assembly for a Crossbow and Method of Using Same", 15 pages.
Office Action for U.S. Appl. No. 15/821,372, mailed on Aug. 5, 2020, Yehle, "Bow", 14 pages.
Office Action for U.S. Appl. No. 15/821,372, mailed on Sep. 9, 2019, Yehle, "Bow", 16 pages.
Office Action for U.S. Appl. No. 15/673,784, mailed on Oct. 19, 2021, Yehle, "Arrow Assembly for a Crossbow and Method of Using Same", 22 pages.
Office Action for U.S. Appl. No. 16/281,239, mailed on Sep. 7, 2021, Yehle, "Reduced Length Crossbow", 23 pages.
The PCT Search Report and Written Opinion mailed Jun. 8, 2021 for PCT application No. PCT/US21/22061, 8 pages.
Alpine Archery True Bowhunting Performance 2010 Catalog, 17 pages.
"New 2017 PSE Evolve Cam System Bows", Webpage Article, Accessed Aug. 16, 2023, https://www.bowhunting.com/blog/2016/10/26/new-2017-pse-evolve-cam-system-bows, 2 pages.
Final Office Action issued in U.S. Appl. No. 16/927,554, dated Sep. 25, 2023.
Final Office Action issued in U.S. Appl. No. 17/883,442, dated Sep. 8, 2023.
Final Office Action issued in U.S. Appl. No. 18/116,153, dated Oct. 4, 2023.
Final Office Action issued in U.S. Appl. No. 18/116,164, dated Oct. 3, 2023.
Photograph of Desert Stryker crossbow sold by Stryker Crossbows and believed to be publicly disclosed no earlier than Jul. 1, 2007,—1 page.
Third Party Submission issued in U.S. Appl. No. 18/116,153, dated Oct. 16, 2023.
Non-Final Office Action issued in co-pending U.S. Appl. No. 17/883,442, dated Apr. 18, 2024.

* cited by examiner

COCKING SYSTEM FOR A CROSSBOW

CROSS-REFERENCE TO RELATED APPLICATIONS

This application claims priority to U.S. Provisional Application No. 62/989,023, filed Mar. 13, 2020, entitled "Crossbow with Pulleys Attached to the Frame," the entirety of which is herein incorporated by reference. The present application is also a continuation of U.S. patent application Ser. No. 16/237,062, entitled "Crossbow with Pulleys that Rotate Around Stationary Axes," filed Dec. 31, 2018, which is a continuation of U.S. patent application Ser. No. 15/782,259, filed Oct. 12, 2017, entitled "Crossbow with Pulleys that Rotate Around Stationary Axes," now U.S. Pat. No. 10,209,026, issued Feb. 19, 2019, which claims the benefit of U.S. Provisional Application Ser. No. 62/441,618, entitled "Crossbow with Pulleys that Rotate Around Stationary Axes," filed Jan. 3, 2017, the entirety of which are herein incorporated by reference.

FIELD OF THE INVENTION

The present disclosure is directed, in part, to a crossbow with pulleys rotatably attached to a center rail or riser of the crossbow, instead of limbs of the crossbow. Power cables may connect the limbs to the pulleys. In some instances, a draw string is enclosed in a safety cover. The crossbow may include a cocking system that moves a string carrier along the center rail to cock and de-cock the crossbow.

BACKGROUND OF THE INVENTION

Bows have been used for many years as a weapon for hunting and target shooting. More advanced bows include cams that increase the mechanical advantage associated with the draw of the draw string. The cams are configured to yield a decrease in draw force near full draw. Such cams preferably use power cables that load the bow limbs. Power cables can also be used to synchronize rotation of the cams, such as disclosed in U.S. Pat. No. 7,305,979 (Yehle).

In conventional bows and crossbows, the draw string is typically pulled away from the generally concave area between the limbs and away from the riser and limbs. This design limits the power stroke for bows and crossbows. In order to increase the power stroke, the draw string can be positioned on the down-range side of the string guides such that the draw string unrolls between the string guides toward the user as the bow is drawn, such as illustrated in U.S. Pat. No. 7,836,871 (Kempf) and U.S. Pat. No. 7,328,693 (Kempf). One drawback of this configuration is that the power cables can limit the rotation of the cams to about 270 degrees. In order to increase the length of the power stroke, the diameter of the pulleys needs to be increased. Increasing the size of the pulleys, however, results in a larger and less usable crossbow.

FIGS. 1-3 illustrate a string guide system for a bow that includes power cables 20A, 20B ("20") attached to respective string guides 22A, 22B ("22") at first attachment points 24A, 24B ("24"). The second ends 26A, 26B ("26") of the power cables 20 are attached to the axles 28A, 28B ("28") of the opposite string guides 22. Draw string 30 engages down-range edges 46A, 46B of string guides 22 and is attached at draw string attachment points 44A, 44B ("44").

As the draw string 30 moves from a released configuration 32 of FIG. 1, to a drawn configuration 34 of FIGS. 2 and 3, the string guides 22 counter-rotate toward each other by about 270 degrees. The draw string 30 unwinds between the string guides 22 from opposing cam journals 48A, 48B ("48") in what is referred to as a reverse draw configuration. As the first attachment points 24 rotate in direction 36, the power cables 20 are wrapped around respective power cable take-up journals of the string guides 22, which in turn bends the limbs toward each other to store the energy needed for the bow to fire the arrow.

Further rotation of the string guides 22 in the direction 36 causes the power cables 20 to contact the power cable take-up journal, stopping rotation of the cam. The first attachment points 24 may also contact the power cables 20 at the locations 38A, 38B ("38"), preventing further rotation in the direction 36. As a result, rotation of the string guides 22 is limited to about 270 degrees, reducing the length 40 of the power stroke.

Crossbows with cams and pulleys mounted on the limbs may be limited by the fact that some of the energy stored in the limbs is dissipated by accelerating masses of the cams and pulleys, and hence, not transmitted to the arrow. Cams and pulleys mounted on the limbs may also be susceptible to being displaced out of the plane of the draw string, resulting in inaccuracy of the bow.

BRIEF SUMMARY OF THE INVENTION

The present disclosure is directed, at least in part, to a crossbow with pulleys rotatably attached to a center rail or riser of the crossbow, instead of the limbs. Power cables connect the limbs to the pulleys. In one embodiment, a draw string of the crossbow is enclosed in a safety cover. The crossbow may include a cocking system that moves a string carrier along the center rail to cock and de-cock the bow.

In one embodiment, a crossbow has a frame including a riser and a center rail, a first flexible limb attached to the frame, a second flexible limb attached to the frame, a first pulley attached to the first flexible limb, and a second pulley attached to the second flexible limb. A first cam assembly is attached to the frame and rotatable about a first axis. The first cam assembly includes a first draw string journal having a first channel disposed on a first plane that is substantially perpendicular to the first axis and a first power cable take-up journal having a second channel that extends in a first direction and about the first axis, the second channel being non co-planar with the first channel. A second cam assembly is attached to the frame and rotatable about a second axis. The second cam assembly includes a second draw string journal having a third channel disposed on a second plane that is substantially perpendicular to the second axis, and a second power cable take-up journal having a fourth channel that extends in a second direction and about the second axis, the fourth channel being non co-planar with the third channel. A draw string is received by the first draw string journal and the second draw string journal, wherein the draw string unwinds from the first draw string journal and the second draw string journal as the draw string translates from a released configuration to a drawn configuration, the draw string departs the first draw string journal at a first location as the draw string unwinds from the first draw string journal, the draw string departs the second draw string journal at a second location as the draw string unwinds from the second draw string journal, a gap that extends between the first location and the second location is about one inch to about six inches, and in the drawn configuration, the draw string has an included angle of less than about seven degrees between the first location and the second location. The crossbow further includes a first power cable having a first end attached to the first power cable take-up journal, the first power cable extending around the first pulley, and attached at a second end to the second flexible limb, and a second power cable having a third end attached to the second power cable take-up journal, the second power cable extending around the second pulley, and attached at a fourth end to the first flexible limb.

In one embodiment, the first draw string journal is offset in the first direction from the first power cable take-up journal by about one inch, and the second draw string journal is offset in the second direction from the second power cable take-up journal by about one inch. In one embodiment, the crossbow further includes a string cover that substantially encloses the draw string as the draw string translates between the released configuration and the drawn configuration. In one embodiment, the gap between the first location and the second location in the drawn configuration is less than about two inches. In one embodiment, the first power cable take up journal rotates at least 270 degrees as the draw string moves between the released configuration and the drawn configuration, and the second power cable take up journal rotates at least 270 degrees as the draw string moves between the released configuration and the drawn configuration. In one embodiment, the second channel comprises a first helical channel that extends in the first direction, about the first axis, and the fourth channel comprises a second helical channel that extends in the second direction, about the second axis.

In one embodiment, the crossbow includes a string carrier attached to the center rail, the string carrier being configured to engage with the draw string when the draw string is in the released configuration, and move the draw string to the drawn configuration. The string carrier may include a catch movable between a closed position that engages the draw string and an open position that releases the draw string, a sear moveable between a cocked position in which the sear retains the catch in the closed position and a de-cocked position that releases the catch to the open position, and a safety moveable between a free position and a safe position that prevents the catch moving to the open position. A trigger attached to the center rail may selectively move the catch from the closed position to the open position that releases the draw string.

In one embodiment, the crossbow may include a string carrier attached to the center rail, the string carrier being configured to engage with the draw string when the draw string is in the released configuration, and move the draw string to the drawn configuration. At least one screw shaft may attach to the center rail and operatively couple to the string carrier, where rotation of the at least one screw shaft moves the string carrier along the center rail, and a trigger attached to the center rail that selectively releases the draw string from the string carrier when the draw string is in the drawn configuration. In one embodiment, a cocking mechanism is attached to the center rail, the cocking mechanism being configured to rotate the at least one screw shaft to move the string carrier along the center rail, the cocking mechanism may include a motor mechanically coupled to the at least one screw shaft, and a battery pack electrically coupled to the motor.

In one embodiment, the crossbow may further include a cocking mechanism attached to a proximal end of the center rail, the cocking mechanism being configured to rotate the at least one screw shaft to move the string carrier along the center rail. The cocking mechanism may include a one-way bearing configured to permit rotation of the at least one screw shaft in response to rotation of a cocking handle in a third direction to move the draw string to the drawn configuration, and prevent rotation of the at least one screw shaft in fourth direction that is opposite the third direction such that the string carrier is retained in a current location along the center rail during a release of the cocking handle. A mechanical clutch may selectively decouple the one-way bearing from the at least one screw shaft, the mechanical clutch being configured to permit rotation of the at least one screw shaft in fourth opposite direction such that rotation of the cocking handle in the fourth direction moves the string carrier towards a distal end of the center rail, the distal end of the center rail being opposite the proximal end of the center rail. The at least one screw shaft comprises a first screw shaft and a second screw shaft. A timing mechanism that synchronizes rotation of the first screw shaft and the second screw shaft.

In another embodiment, a cocking system for a crossbow has at least a first flexible limb attached to a riser and second flexible limb attached to the riser, and a draw string that translates along a center rail of the crossbow between a released configuration and a drawn configuration. The cocking system may include a string carrier received by the center rail, the string carrier being configured to translate between a first position to engage with the draw string when the draw string is in the released configuration, and a second position to move the draw string to the drawn configuration, and at least one screw shaft attached to the center rail and engaged with the string carrier, wherein rotation of the at least one screw shaft translates the string carrier along the center rail between the first position and the second position. A one-way bearing may engage with the at least one screw shaft, the one-way bearing being configured to permit rotation of the at least one screw shaft in response to a rotation of a cocking handle in a first direction to move the string carrier to the second position, and prevent rotation of the at least one screw shaft in a second direction such that the string carrier is retained in a current location along the center rail during a release of the cocking handle. A mechanical clutch may selectively disengage the one-way bearing and the at least one screw shaft to permit rotation of the at least one screw shaft in the second direction, wherein rotation of the cocking handle in the second direction moves the string carrier to the first position.

In one embodiment, the cocking system may include a motor mechanically coupled to the at least one screw shaft, and a battery pack electrically coupled to the motor. In one embodiment, the string carrier includes a catch movable between a closed position that engages the draw string and an open position that releases the draw string, a sear moveable between a cocked position to retain the catch in the closed position and a de-cocked position that releases the catch to the open position, and a safety moveable between a free position and a safe position that prevents the catch from moving to the open position. The crossbow further includes a trigger attached to the center rail that selectively releases the draw string from the string carrier while the string carrier is in the second position. In one embodiment, a cover substantially encloses the draw string as the draw string translates between the released configuration and the drawn configuration. In one embodiment, a first portion of the draw string is engaged with a first cam attached to the riser and a second portion of the draw string is engaged with a second cam attached to the riser. In one embodiment, the at least one screw shaft includes a first screw shaft attached to the center rail and disposed along a first side of the center rail, and a second screw shaft attached to the center rail and disposed along a second side of the center rail.

In another embodiment, a method of cocking a crossbow may include engaging a string carrier of a crossbow with a draw string of the crossbow and rotating a screw shaft of the crossbow in a first direction to translate the string carrier from a first position in which the crossbow is in a released configuration to a second position in which the crossbow is in a drawn configuration. The screw shaft is restricted from rotating in a second direction via a one-way bearing that engages with the screw shaft in instances where rotation of the screw shaft in the first direction is ceased, and the screw shaft is permitted to rotate in the second direction in instances where a clutch is actuated to disengage the one-way bearing and the screw shaft.

In one embodiment, rotating the screw shaft includes at least one of rotating a cocking handle mechanically coupled to the screw shaft, or powering a motor mechanically coupled to the screw shaft. In one embodiment, the draw string is retained at least partially within a cover as the string carrier translates from the first position to the second position.

DETAILED DESCRIPTION OF THE INVENTION

Figure 1:
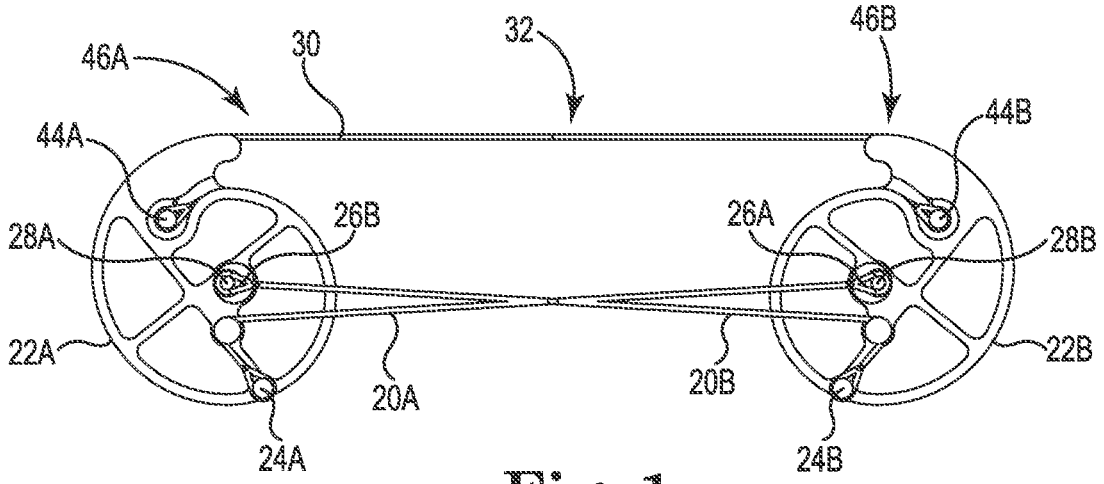
Fig. 1 PRIOR ART
FIG. 1 is a bottom view of a prior art string guide system for a bow in a released configuration.
Figure 2:
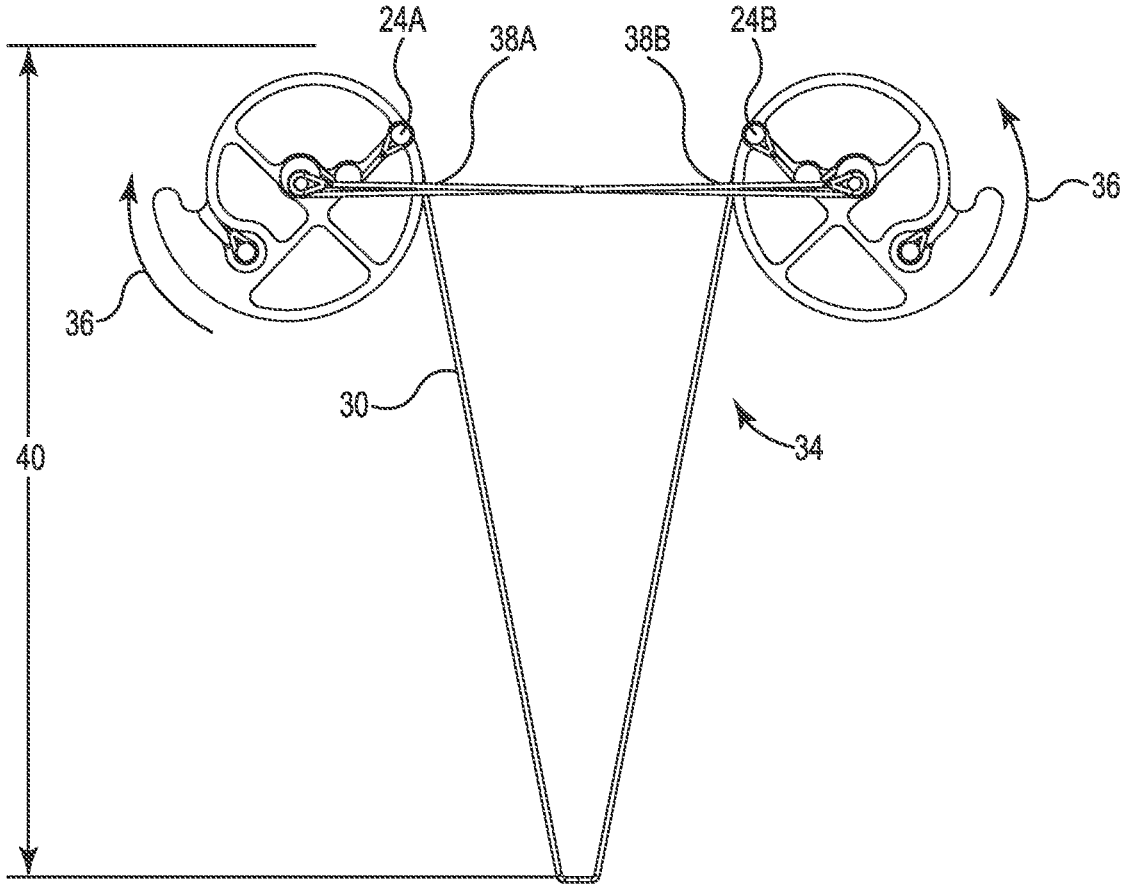
Fig. 2 PRIOR ART
FIG. 2 is a bottom view of the string guide system of FIG. 1 in a drawn configuration.
Figure 3:
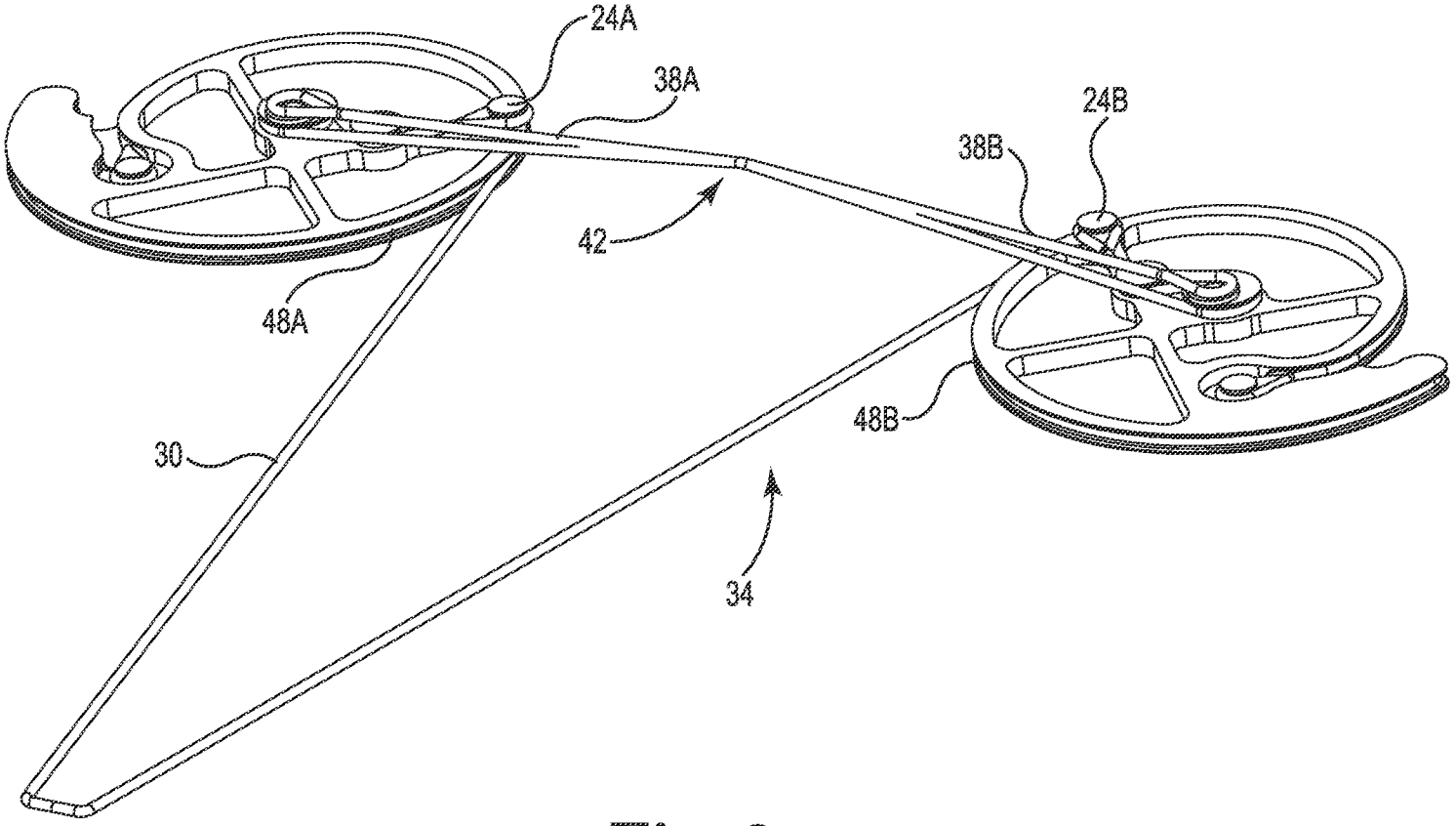
Fig. 3 PRIOR ART
FIG. 3 is a perspective view of the string guide system of FIG. 1 in a drawn configuration.
Figure 4:
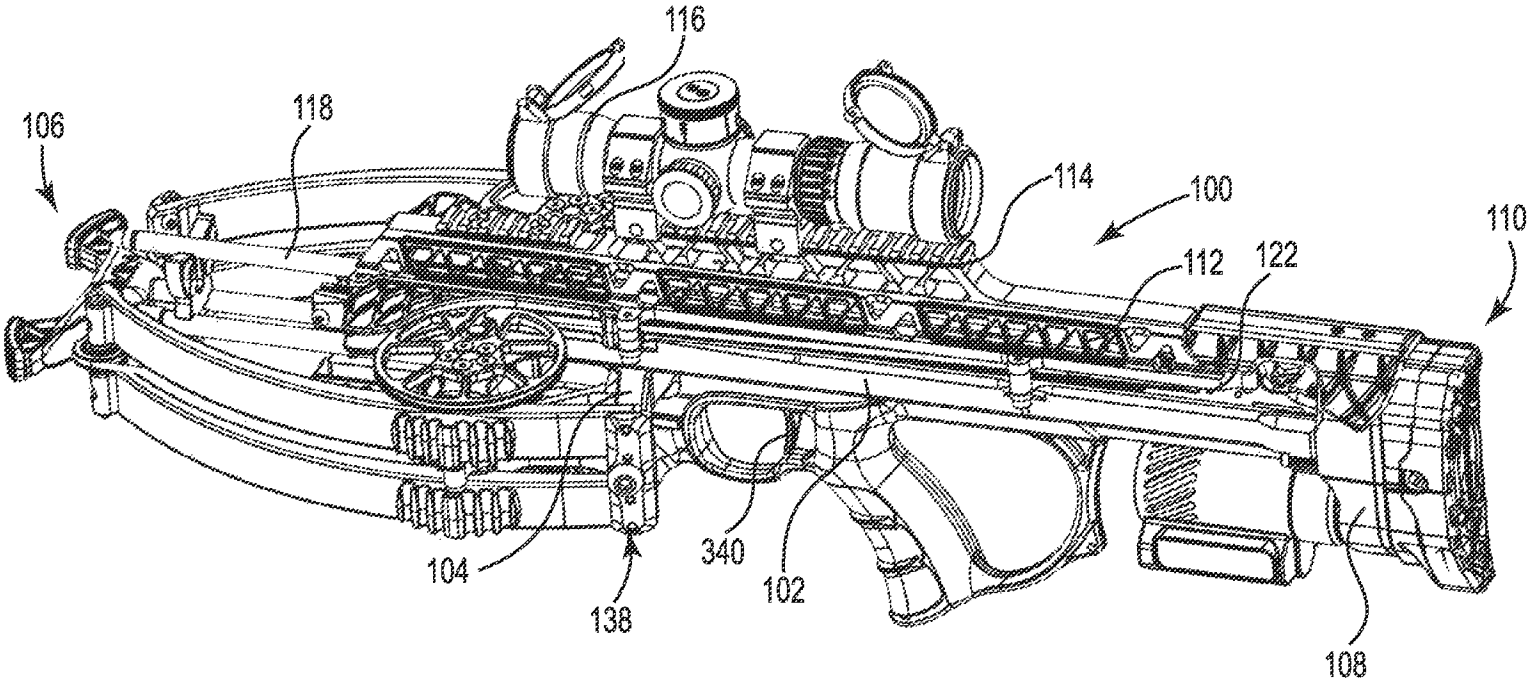
FIG. 4 is a perspective view of an example crossbow in accordance with an embodiment of the present disclosure.

FIG. 4 is a perspective view of a crossbow 100 in accordance with an embodiment of the present disclosure. The crossbow 100 includes a center rail 102 with a riser 104 mounted at a distal end 106 and a stock 108 located at a proximal end 110. As used herein, the center rail 102 and the riser 104 may comprise a frame 138. The frame 138 may be a unitary structure, such as, for example, a molded carbon fiber component or separate components.

The frame 138 includes a string cover 112 that may substantially enclose movement of a draw string (See FIGS. 6A and 6B) and a string carrier 122. A scope mount 114 with a tactical, picatinny, or weaver mounting rail is attached to, or integrally formed with, the string cover 112. A scope 116 may include a reticle with gradations corresponding to the ballistic drop of arrows 118 of a particular weight. The terms "bolt" and "arrow" are both used for the projectiles launched by crossbows and are used interchangeable herein. Various arrows and nocks are disclosed in commonly assigned U.S. patent application Ser. No. 15/673,784 entitled "Arrow Assembly for a Crossbow and Methods of Using Same," filed Aug. 10, 2017, which is hereby incorporated by reference.

Figure 5A:
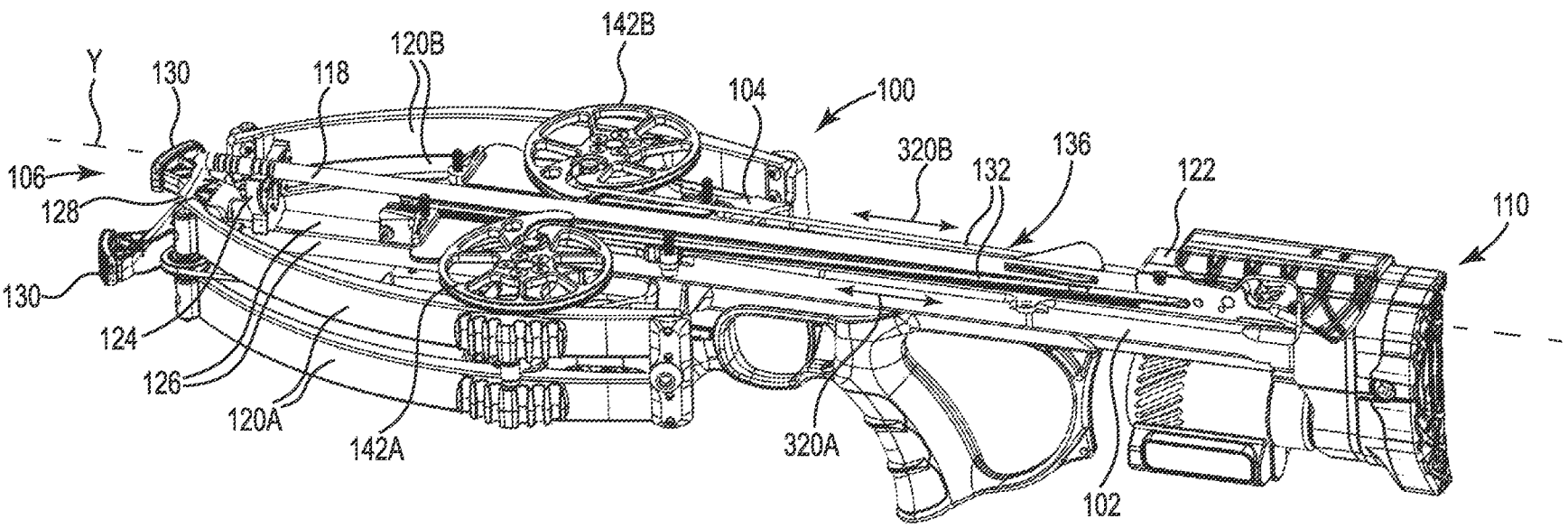
FIG. 5A is a perspective view of the crossbow of FIG. 4, with a safety cover of the crossbow removed.
Figure 5B:
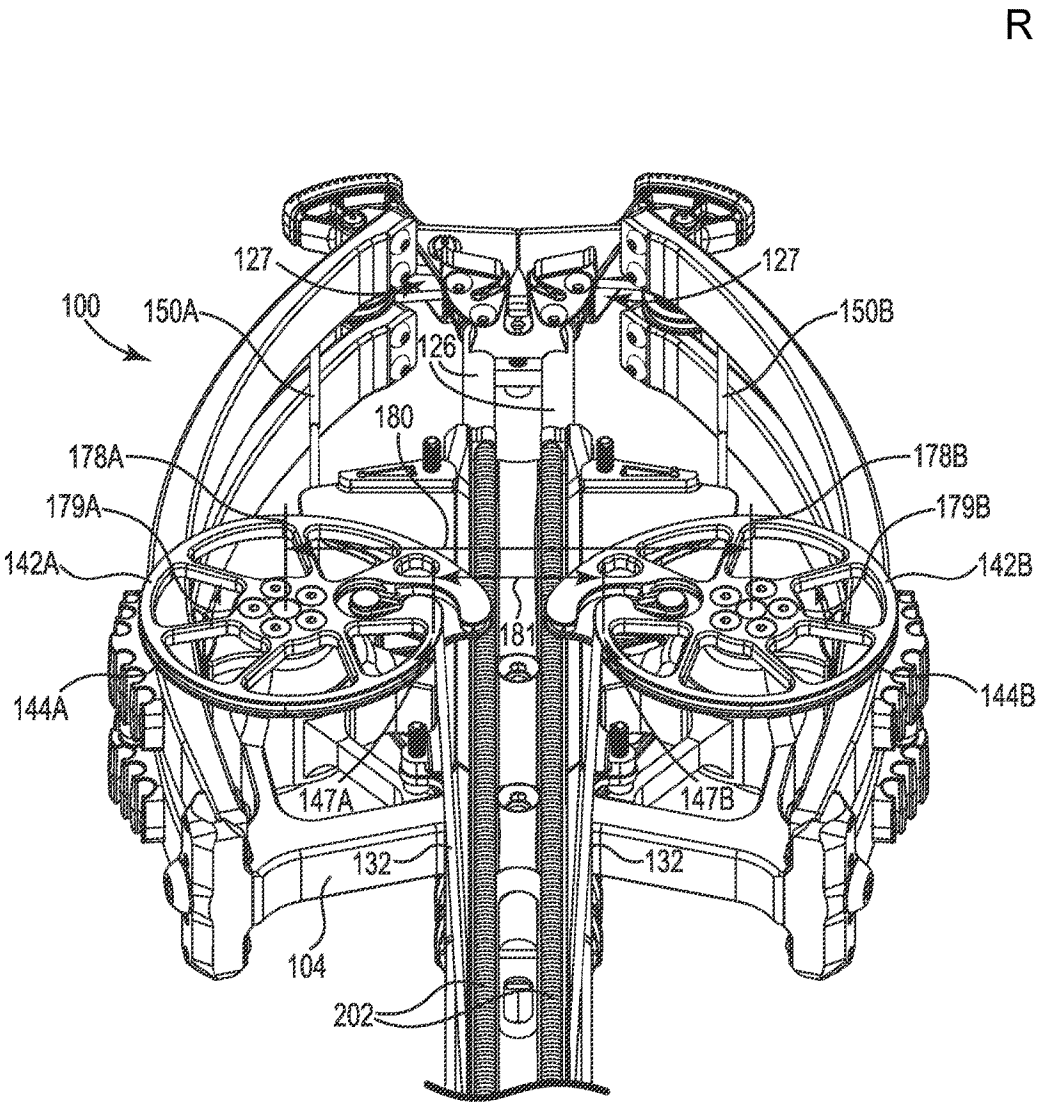
FIG. 5B is a perspective view of cams of the crossbow of FIG. 4.

FIGS. 5A and 5B illustrate the crossbow 100 with the string cover 112 removed. A draw string 132 is shown in a drawn configuration 136. The riser 104 includes pairs of limbs 120A, 120B ("120") extending forward toward the distal end 106. In the illustrated embodiment, the limbs 120 have a generally concave shape directed toward a center axis Y of the center rail 102. Cams 142A, 142B ("142") are preferably mounted directly to the frame 138, rather than the limbs 120. In the illustrated embodiment, the cams 142 are mounted to the riser 104. In an alternate embodiment the cams 142 may be mounted to the center rail 102.

The arrow 118 is shown suspended above the center rail 102 by the string carrier 122 located near the proximal end 110 and tunable arrow rest 124 near the distal end 106. The string carrier 122 contains a trigger mechanism substantially as described in U.S. Pat. No. 10,209,026, which is hereby incorporated by reference. The tunable arrow rest 124 is mounted to the center rail 102 by a pair of rods 126 that extend forward from the riser 104. Cable guard 128 attached to distal ends of the rods 126 includes bumpers 130 to support the crossbow 100. Power cables ("150A, 150B") pass through an opening 127 in the cable guard 128.

In the drawn configuration 136, tension forces 320A, 320B ("320") on the draw string 132 on opposite sides of the string carrier 122 are substantially the same, resulting in increased accuracy. In one embodiment, the tension force 320A is the same as tension force 320B within less than about 1.0%, and more preferably less than about 0.5%, and most preferably less than about 0.1%. Consequently, cocking and firing the crossbow 100 is highly repeatable. To the extent that manufacturing variability creates inaccuracy in the crossbow 100, any such inaccuracy is likewise highly repeatable, which can be compensated for with appropriate windage and elevation adjustments in the scope 116. The repeatability provided by the string carrier 122 results in the crossbow 100 being highly accurate at distances beyond the capabilities of prior crossbows.

As the draw string 132 moves from a released configuration 134 (see FIG. 6A) to the drawn configuration 136, the cams 142 rotation around cam axes 178A, 178B ("178") in directions 179A, 179B ("179"), respectively. Since the cams 142 are mounted to the riser 104, rather than the limbs 120, separation 180 between the axes 178 is fixed. The separation 180 between the axes 178 is preferably between about 4 inches to about 6 inches.

Rotation of the cams 142 in the directions 179 causes the draw string 132 to unwind from the draw string journals 144 at tangent points 147A, 147B ("147"). The tangent points 147 move and a gap 181 changes as the draw string 132 moves between the released configuration 134 and the drawn configuration 136. In the present embodiment, the maximum gap 181 is between about 1 inch and about 4 inches, and the minimum gap 181 is between about 1 inch and about 3 inches. Consequently, in the drawn configuration 136, the maximum width of the area occupied by the draw string 132 corresponds to the gap 181.

Figure 5C:
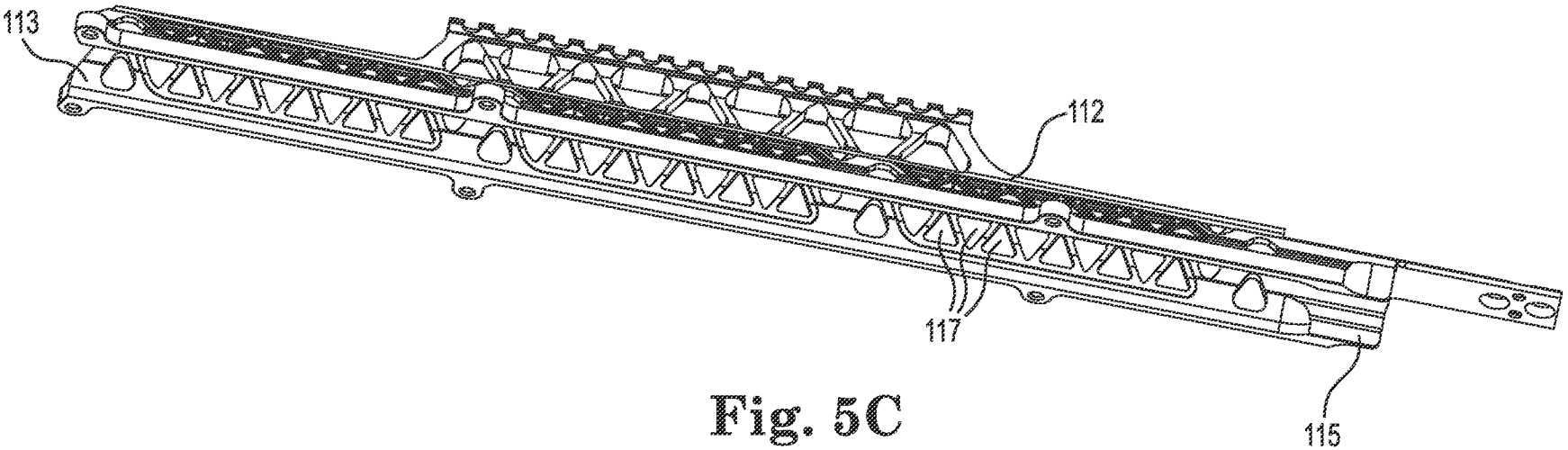
FIG. 5C is a perspective view of the safety cover of the crossbow of FIG. 4.

FIG. 5C illustrates the string cover 112 in accordance with one embodiment of the present disclosure. The string cover 112 is preferably at least partially transparent to assist the user in loading and unloading an arrow, and to monitor activities of the draw string 132. In the illustrated embodiment, the string cover 112 includes cut-outs 117. In another embodiment, some or all of the string cover 112 may be constructed from a transparent material. The cut-outs 117 are preferably configured so that a user is unable to place fingers in the draw string path.

Distal end 113 of the string cover 112 is sized to accommodate the maximum gap 181 between the tangent points 147, so that the draw string 132 may be contained within the string cover 112. Since the string carrier 122 captures a segment of the draw string 132 that is smaller than the minimum gap 181, the draw string 132 forms a V-shaped configuration in the drawn configuration 136 with the narrow portion of the "V" near the proximal end 115 of the string cover 112. Consequently, the string cover 112 may optionally be narrower near the proximal end 115.

Figure 6A:
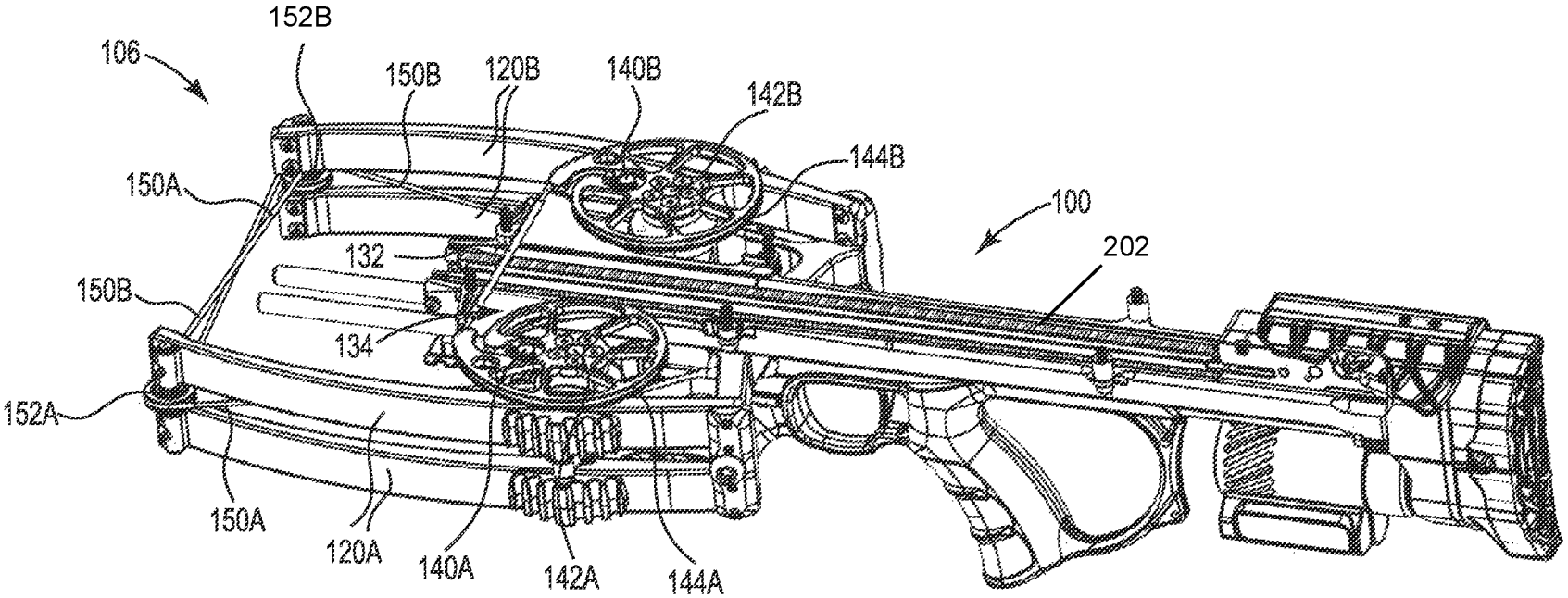
FIG. 6A is a perspective view of the crossbow of FIG. 5A in a released configuration.
Figure 6B:
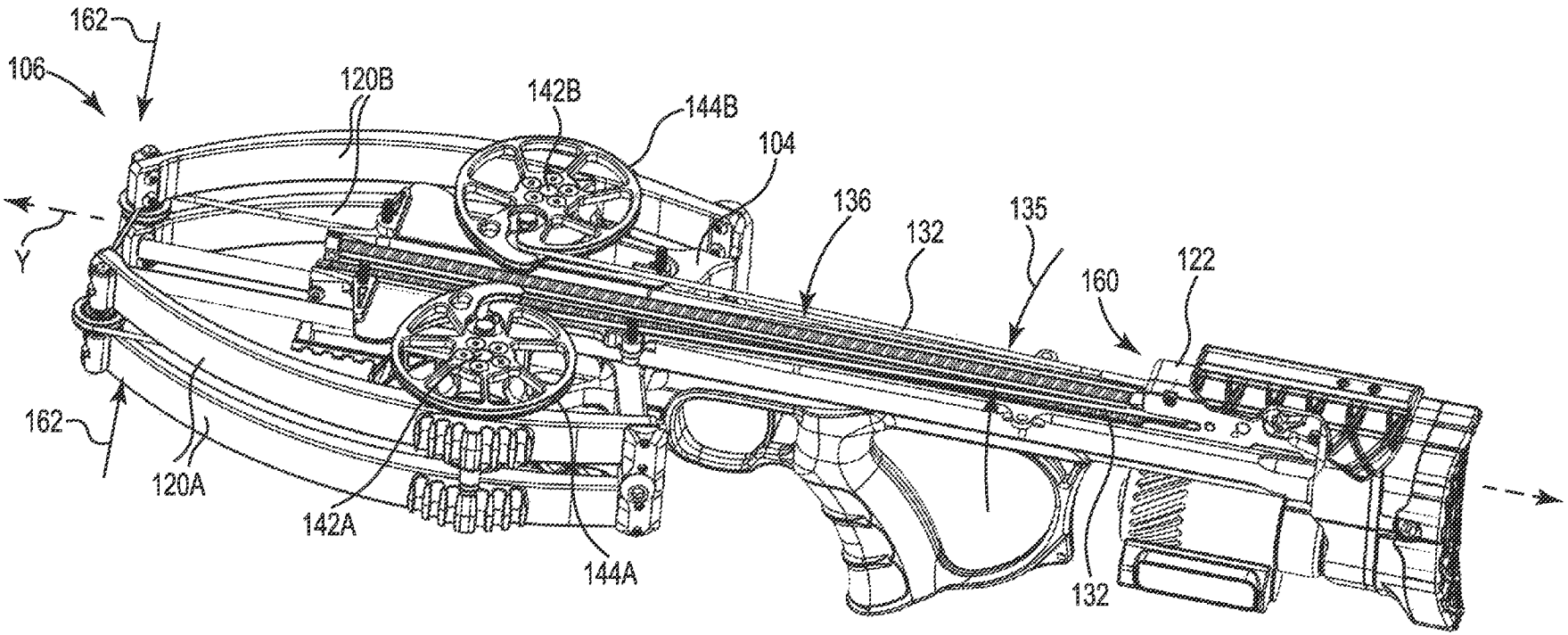
FIG. 6B is a perspective view of the crossbow of FIG. 5A in the drawn configuration.

FIGS. 6A and 6B illustrate the crossbow 100 with the string cover 112, cable guard 128 and the arrow rest 124 removed to better illustrate the cabling configuration. FIG. 6A illustrates the draw string 132 in a released configuration 134. In the illustrated embodiment, the draw string 132 is located adjacent to a down-range side of the cams 142 when in the released configuration 134 in what is known as a reverse draw configuration.

Distal ends of the draw string 132 are connected to attachment points 140A, 140B ("140") on the cams 142A, 142B ("142"), respectively. When in the released configuration 134, the bulk (e.g., majority) of the draw string 132 is collected in draw string journals 144A, 144B ("144") on the cams 142, respectively. The power cable 150A is operatively coupled to the cam 142A (see FIG. 7A), extends around idler pulley 152A mounted to distal ends of limbs 120A, and is attached to distal ends of the limbs 120B, preferably to an axis of the idler pulley 152B. Similarly, the power cable 150B is operatively coupled to cam 142B (see FIG. 7A), extends around idler pulley 152B mounted to distal ends of limbs 120B and is attached to distal ends of limbs 120A, preferably to an axis of the idler pulley 152A. The idler pulleys 152 are typically circular, but could optionally be cam shaped.

FIG. 6B illustrates the draw string 132 in the drawn configuration 136. As will be discussed herein, the string carrier 122 slides forward along the center rail 102 toward the riser 104 to engage the draw string 132 while it is in the released configuration 134 (see e.g., FIG. 6A). The string carrier 122 is then moved to the retracted position 160 illustrated in FIG. 6B to retain the draw string 132 in the drawn configuration 136. The draw string 132 unwinds from the draw string journals 144 as the cams 142 counter-rotate. As the cams 142 rotate the power cables 150 are simultaneously accumulated on power cable take-up pulleys 174 (See FIG. 7A), causing the limbs 120 to deflect inward in direction 162 toward the Y axis.

When in the drawn configuration 136 illustrated in FIG. 6B the draw string 132 exhibits an included angle 135. The included angle 135 is the angle defined by the draw string 132 on either side of the string carrier 122 when in the drawn configuration 136 (or relative to a longitudinal axis of the crossbow 100. The included angle 135 is preferably less than about 10 degrees, and more preferably less than about 7 degrees. In the illustrated embodiment, the included angle 135 in the drawn configuration 136 is typically between about 3 degrees to about 7 degrees. The string carrier 122 includes a catch 252 (see e.g., FIG. 15) that engages a narrow segment of the draw string 132 and permits the included angle 135.

The included angle 135 that results from the gap 181 between the tangent points 147 does not provide sufficient space to accommodate conventional cocking mechanisms, such as cocking ropes and cocking sleds disclosed in U.S. Pat. No. 6,095,128 (Bednar); U.S. Pat. No. 6,874,491 (Bednar); U.S. Pat. No. 8,573,192 (Bednar et al.); U.S. Pat. No. 9,335,115 (Bednar et al.); and 2015/0013654 (Bednar et al.), which are all hereby incorporated by reference. It will be appreciated that the cocking systems disclosed herein are applicable to any type of crossbow, including recurved crossbows that do not include cams or conventional compound crossbows with power cables that crossover.

Figure 7A:
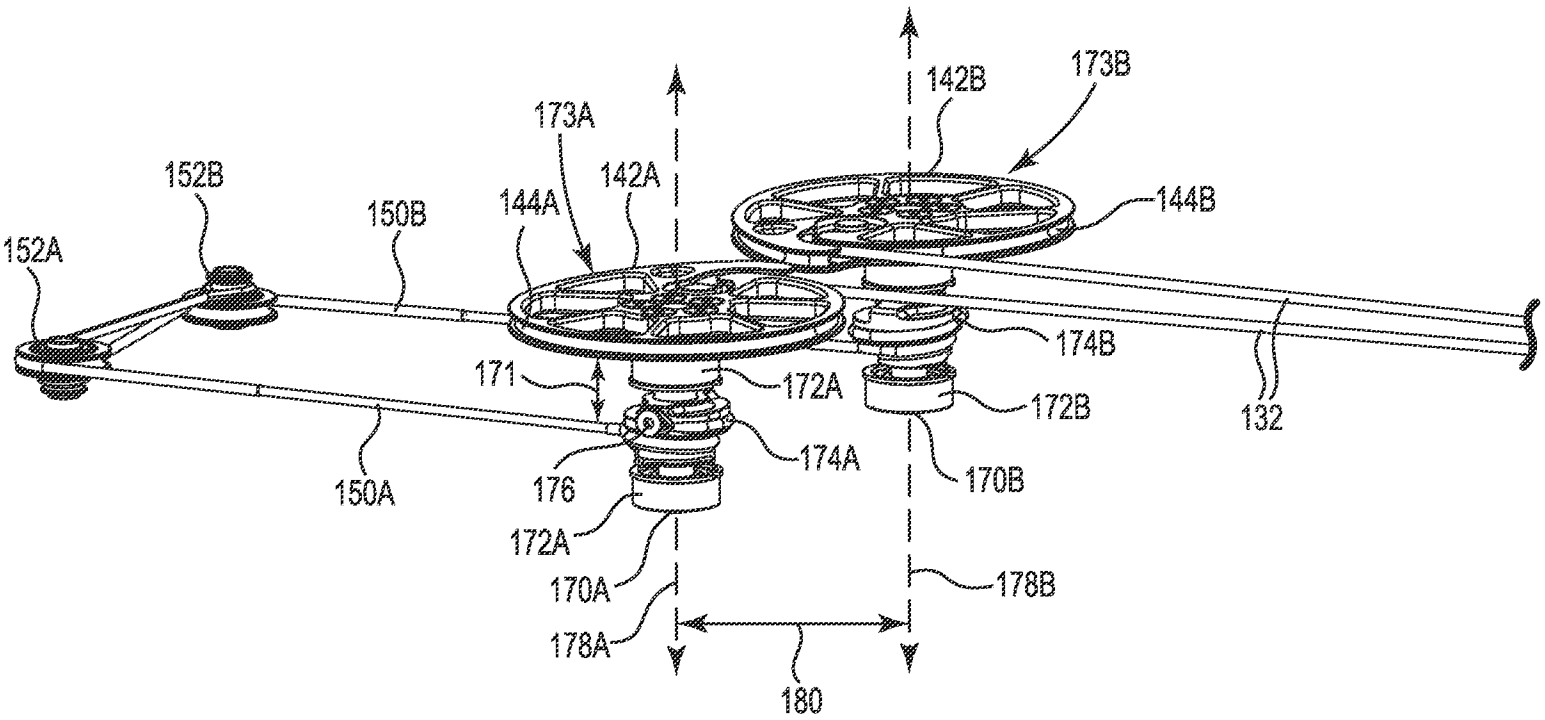
FIGS. 7A-7C illustrate an example cam system for a crossbow in accordance with an embodiment of the present disclosure.

FIG. 7A illustrates cam assemblies 173A, 173B ("173") that include cams 142 and power cable take-up pulleys 174A, 174B ("174") that rotate around axes 178. In the illustrated embodiment, the cams 142 and power cable take-up pulleys 174 are mounted to rigid cam axles 170A, 170B ("170") and are separated by about one inch. Offset 171 between the cams 142 and the power cable take-up pulleys 174 may increase or decrease depending on particular design considerations. It will be appreciated that the cams 142 and power cable take-up pulleys 174 may be located adjacent each other, such as disclosed in U.S. Pat. No. 10,209,026 (Yehle).

Upper and lower bearings 172A, 172B ("172") are mounted to the cam axles 170 above and below power cable take-up pulleys 174. The bottom bearings 172 couple with the riser 104 (see FIG. 8) to minimize deflection of the cams 142, the cam axles 170, and the power cable take-up pulleys 174 relative to the center rail 102, while permitting rotations of the cam 142 and the power cable take-up pulley 174. The bottom bearings 172 are preferably attached to the cam axles 170 with a spring clip that applies a preload that biases the cams 142 and the bottom bearings 172 downward and minimizes movement along the axes 178 during operation of the crossbow 100. In particular, the spring clip prevents the cams 142 from moving upward along the axes 178 as the crossbow 100 is fired, potentially introducing inaccuracy.

Figure 7B:
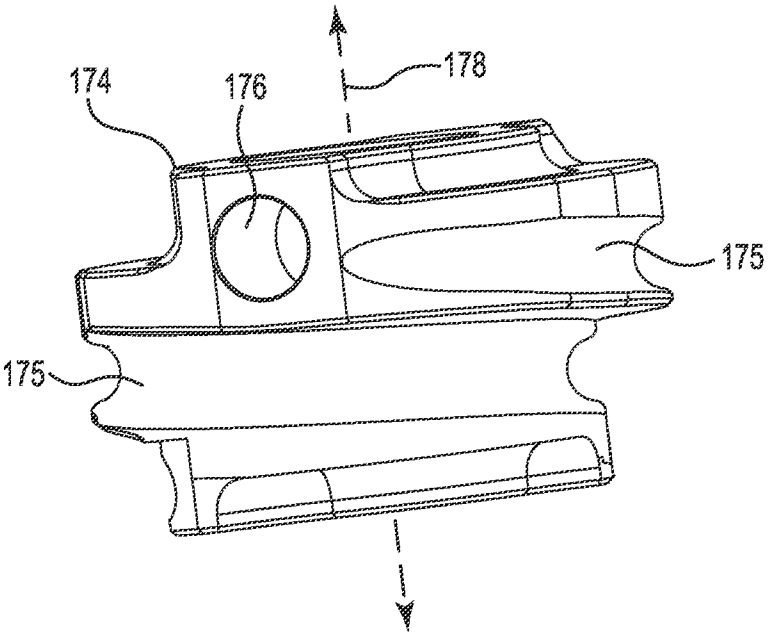
Figure 7C:
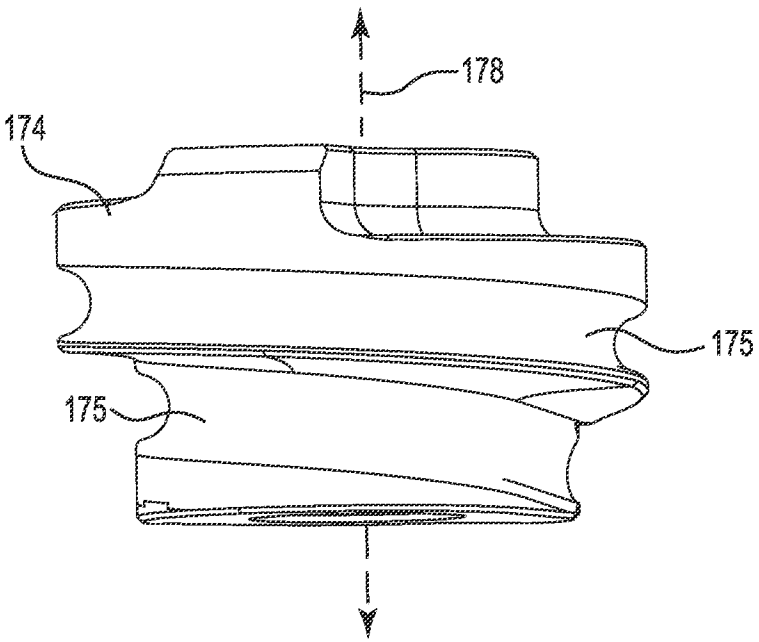

FIGS. 7B and 7C illustrate the power cable take-up pulleys 174 with the power cable 150 removed. The power cable take-up pulleys 174 include power cable journals 175 and anchor points 176 for attaching the power cables 150. In the illustrated embodiment, the power cable journals 175 are spiraled about the axes 178, but can be helical or a variety of other shapes. Due to the spiral or helical configuration of the power cable journals 175, the power cables 150 are displaced relative along cam axes 178A, 178B ("178") of the cam axles 170 as the draw string 132 moves between the drawn configuration 136 and the released configuration 134.

Figure 8:
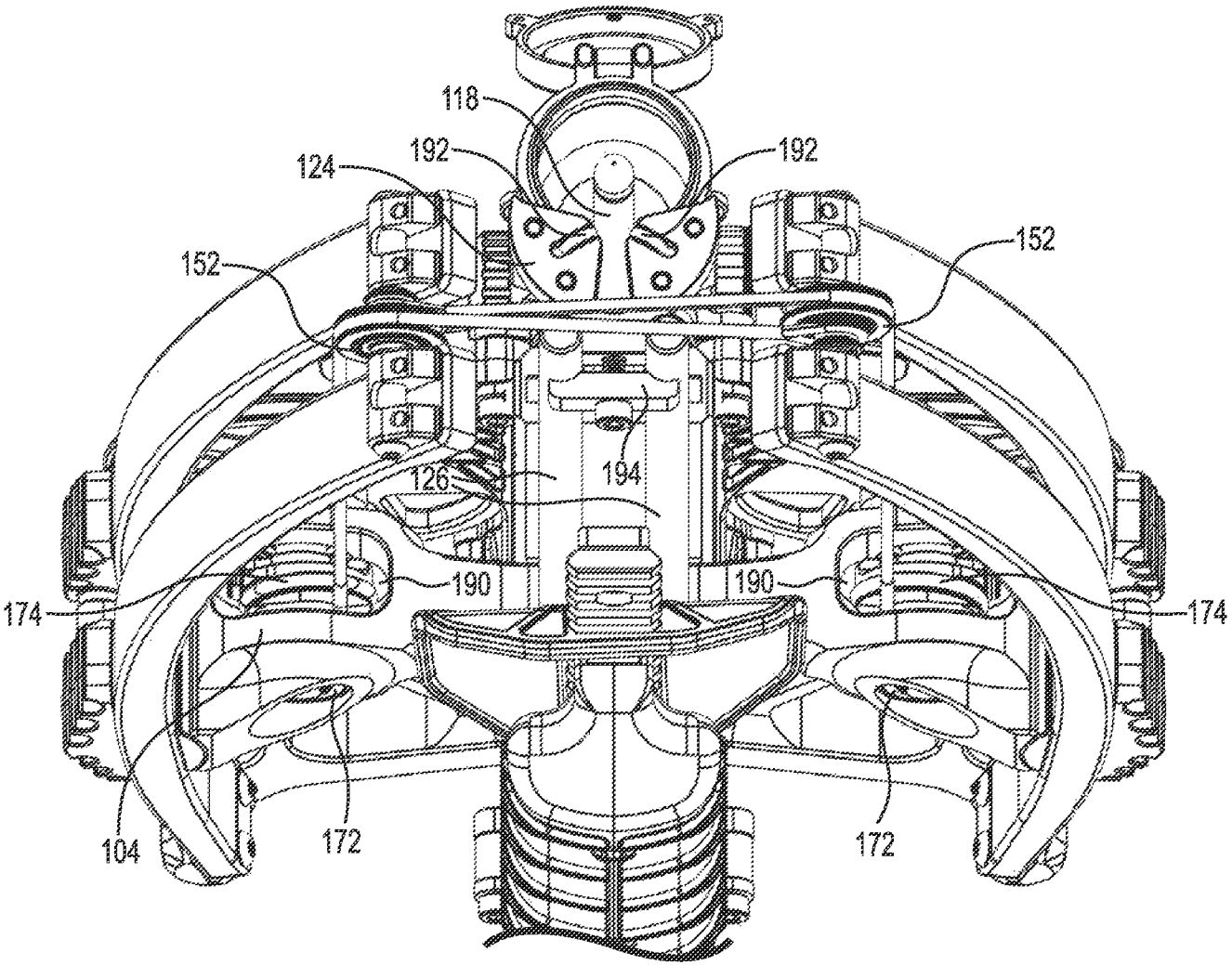
FIGS. 8 and 9 are front views of the crossbow of FIG. 4.

FIG. 8 is a lower perspective view of the crossbow 100 with the cable guard 128 removed to illustrate openings 190 in the riser 104 where the power cable take-up pulleys 174 are located. Openings 190 are sized to accommodate movement of the power cables 150 along the cam axes 178 as the draw string 132 moves between the drawn configuration 136 and the released configuration 134. Portions of the bottom bearings 172 are also visible. FIG. 8 also illustrates an arrow rest mount 194 fastened to rods 126. The arrow rest 124 preferably includes a pair of rollers 192 that are spring loaded toward the arrow 118.

Figure 9:
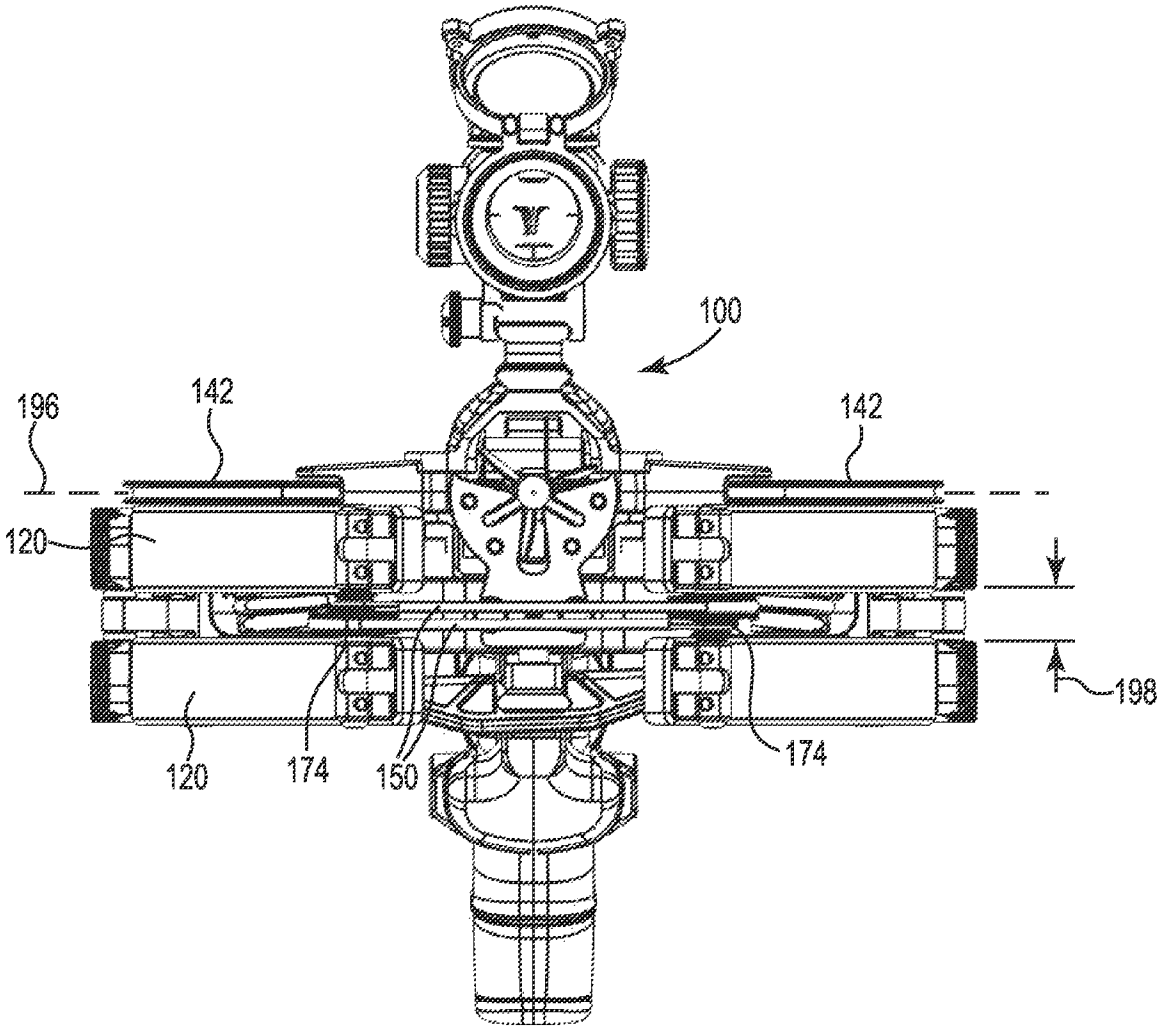

FIG. 9 is a front view of the crossbow 100 with the cable guard 128 removed to illustrate how the components are stacked vertically. The arrow 118 preferably travels in the plane 196 during launch. The draw string 132 and the arrow 118 travel substantially along the plane 196. Power cable journals 175 (see FIGS. 7B and 7C) and the power cables 150 are located generally in a gap 198 between the limbs 120. The power cable journals 175 define paths that are not co-planar with the plane 196 of the cams 142. While the power cables 150 cross over the centerline of the crossbow 100, the idler pulleys 152 prevent the power cables 150 contacting each other, eliminating the friction in prior art cabling schemes that dissipate power. Also, the power cables 150 are located out of the plane 196 of the cams 142.

Figure 10:
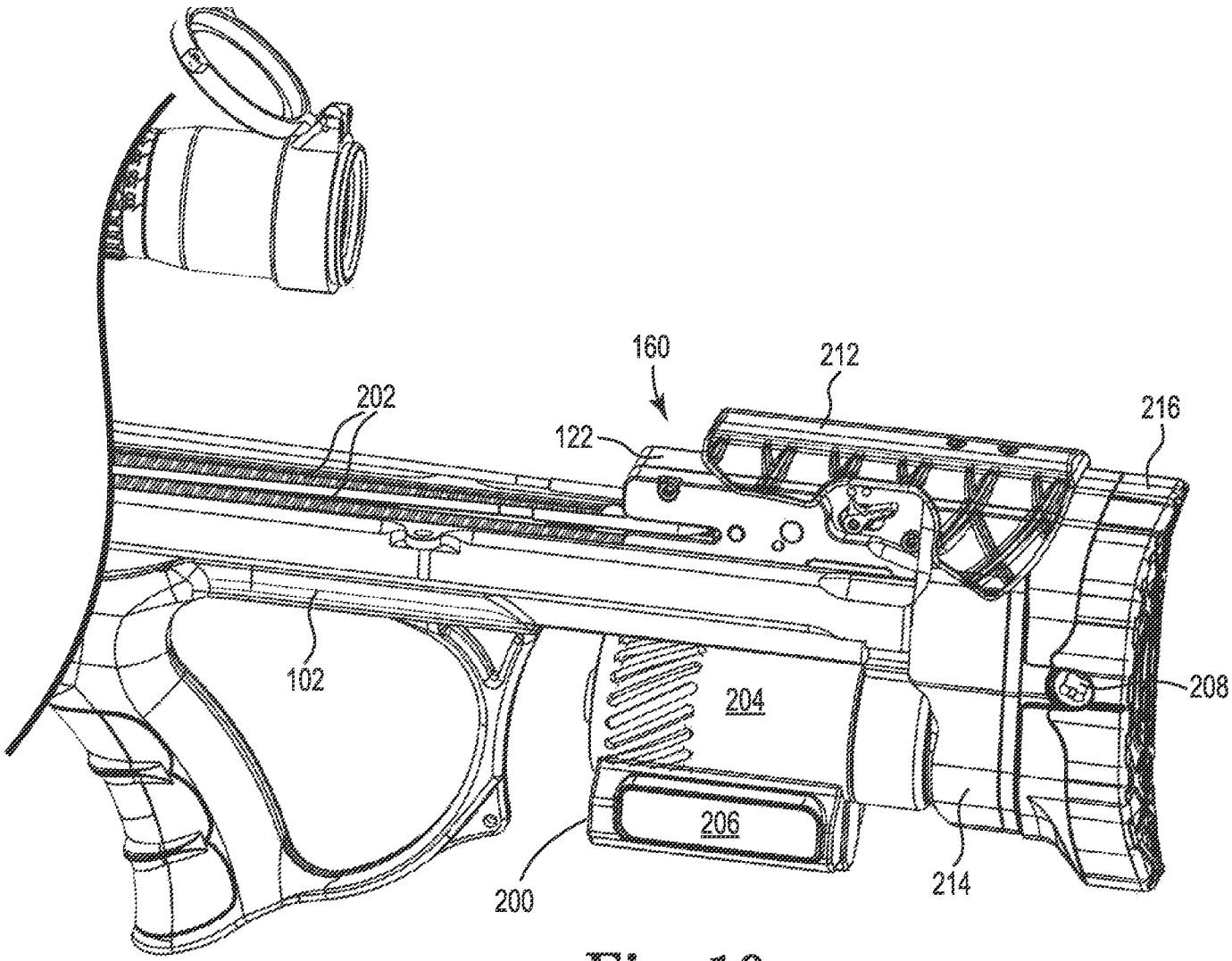
FIGS. 10-14 illustrate an example cocking system for a crossbow in accordance with an embodiment of the present disclosure.
Figure 11A:
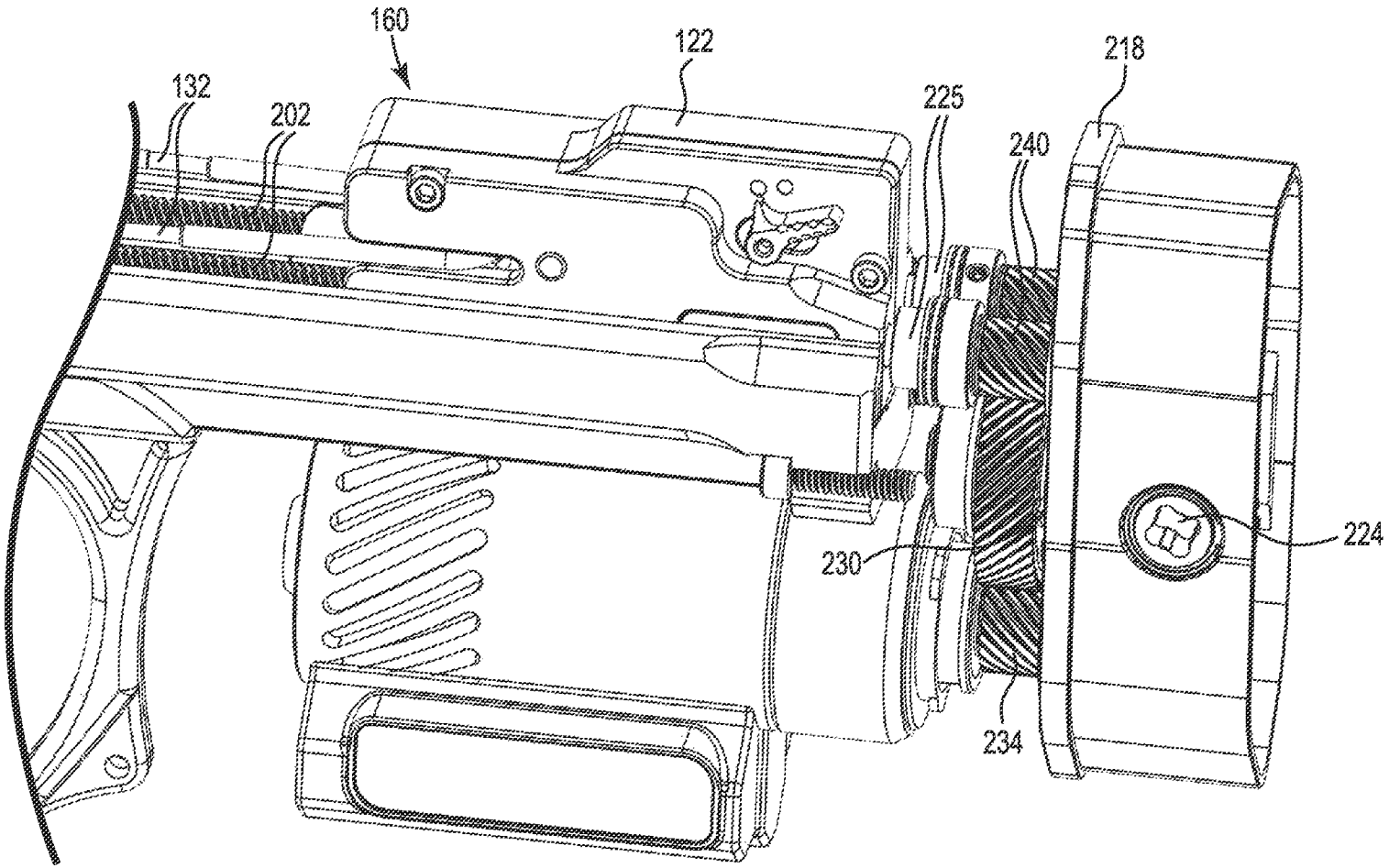
Figure 11B:
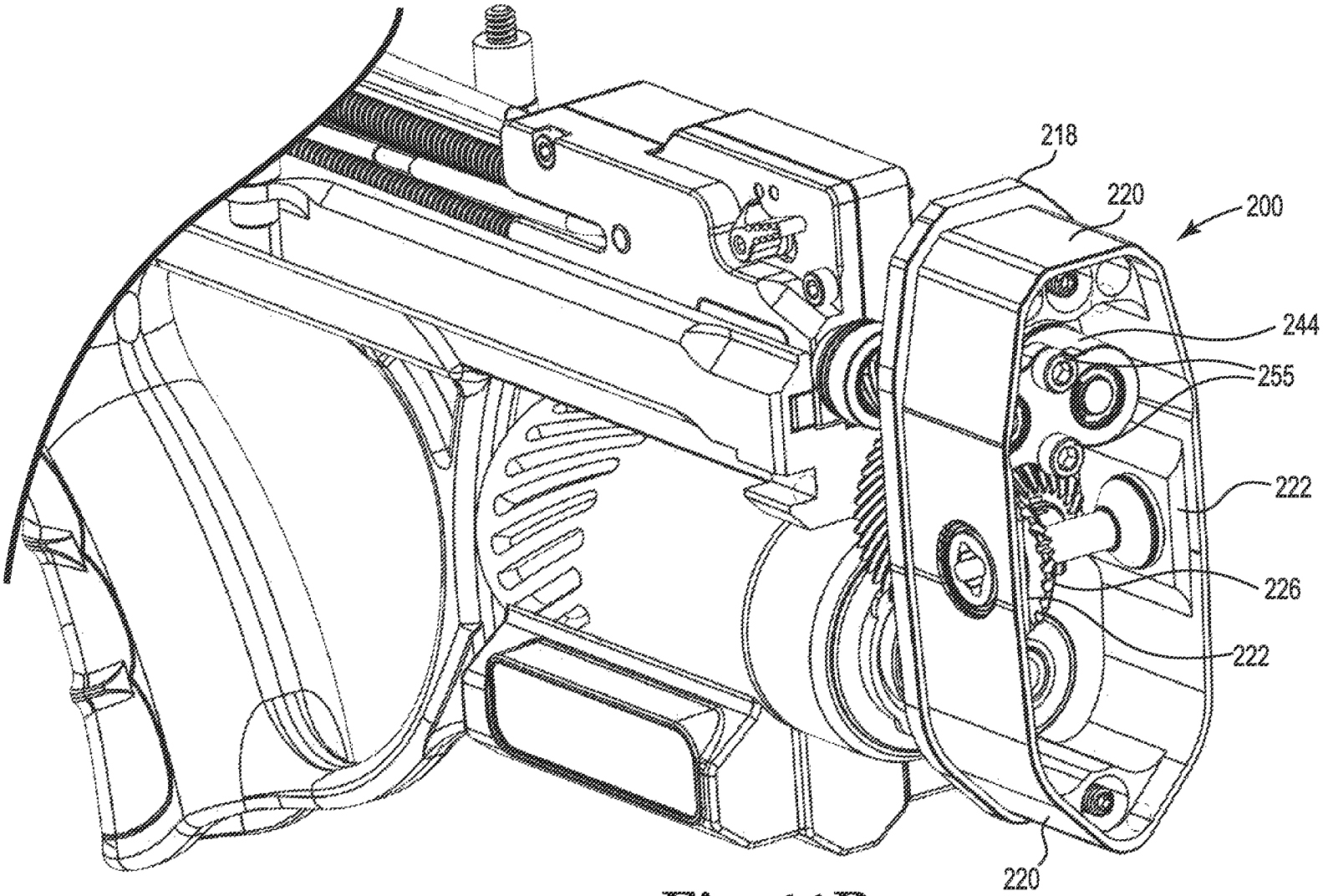

FIGS. 10, 11A, and 11B illustrate a cocking system 200 for the crossbow 100 in accordance with an embodiment of the present disclosure. The cocking system 200 is partially concealed by a cheek rest 212, a gear box cover 214, and an adjustable butt plate 216. In FIGS. 10, 11A, and 11B, the string cover 112 is removed and the string carrier 122 is in the retracted position 160. The string carrier 122 is operatively coupled to screw shafts 202A, 202B ("202") by coupling 201 (See FIG. 15). Rotation of the screw shafts 202 causes the string carrier 122 to move back and forth along the center rail 102. As illustrated in FIG. 6A, the screw shafts 202 extend past the draw string 132 when in the released configuration 134, permitting the string carrier 122 to capture the draw string 132. The cocking system 200 may be operated electrically using a motor 204 and battery pack 206 or manually by inserting a cocking handle into recess 208.

The string carrier 122 is preferably captured by the center rail 102 and moves in a single degree of freedom along a Y-axis. The engagement of the string carrier 122 with the center rail 102 substantially prevents the string carrier 122 from moving in the other five degrees of freedom (X-axis, Z-axis, pitch, roll, or yaw) relative to the center rail 102 and the riser 104. As a result, the draw string 132 remains substantially in the plane 196 (see FIG. 9) as it moves between the drawn configuration 136 and the released configuration 134. As used herein, "captured" refers to a string carrier that cannot be removed from the center rail without disassembling the crossbow or the string carrier. As illustrated in FIG. 11A, bearings 225 act as a positive stop that prevents the string carrier 122 from being moved past the retracted position 160.

Figure 12:
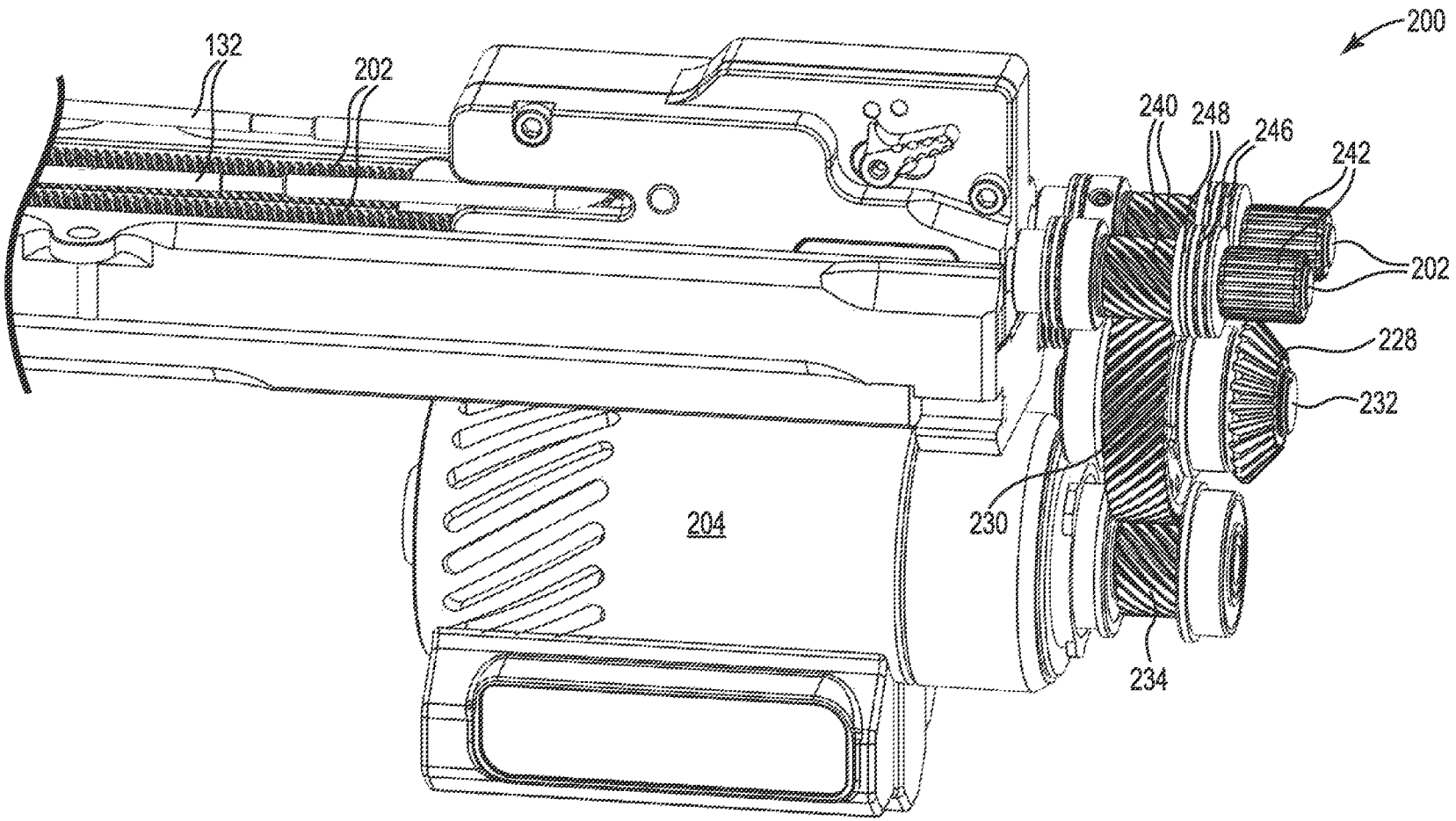

FIGS. 11A, 11B, and 12 illustrate the cocking system 200 with the cheek rest 212, the gear box cover 214, and the butt plate 216 removed. The gear cover 218 includes telescoping butt plate mounts 220 that permits the position of the butt plate 216 to be adjusted along the Y-axis of the crossbow 100. A pair of support plates 222 mounted to the gear cover 218 support axle 224 containing bevel gears 226. Rotation of the support axle 224 with a cocking handle causes the bevel gear 226 to rotate intermediate bevel gear 228 (see FIG. 12).

As best illustrated in FIG. 12 the bevel gear 228 is keyed to a shaft 232. FIG. 12 illustrates the gear cover 218 removed. Intermediate spiral gear 230 is coupled to the shaft 232 by a ball clutch system 231 (see FIG. 13) that limits the torque that may be applied by the spiral gear 230 to the spiral gears 240 coupled to the screw shafts 202. Alternatively, the motor 204 may rotate motor gear 234, which rotates the intermediate spiral gear 230. The motor 204 is preferably torque limited to limit the amount of torque applied to the cocking system 200.

Figure 13:
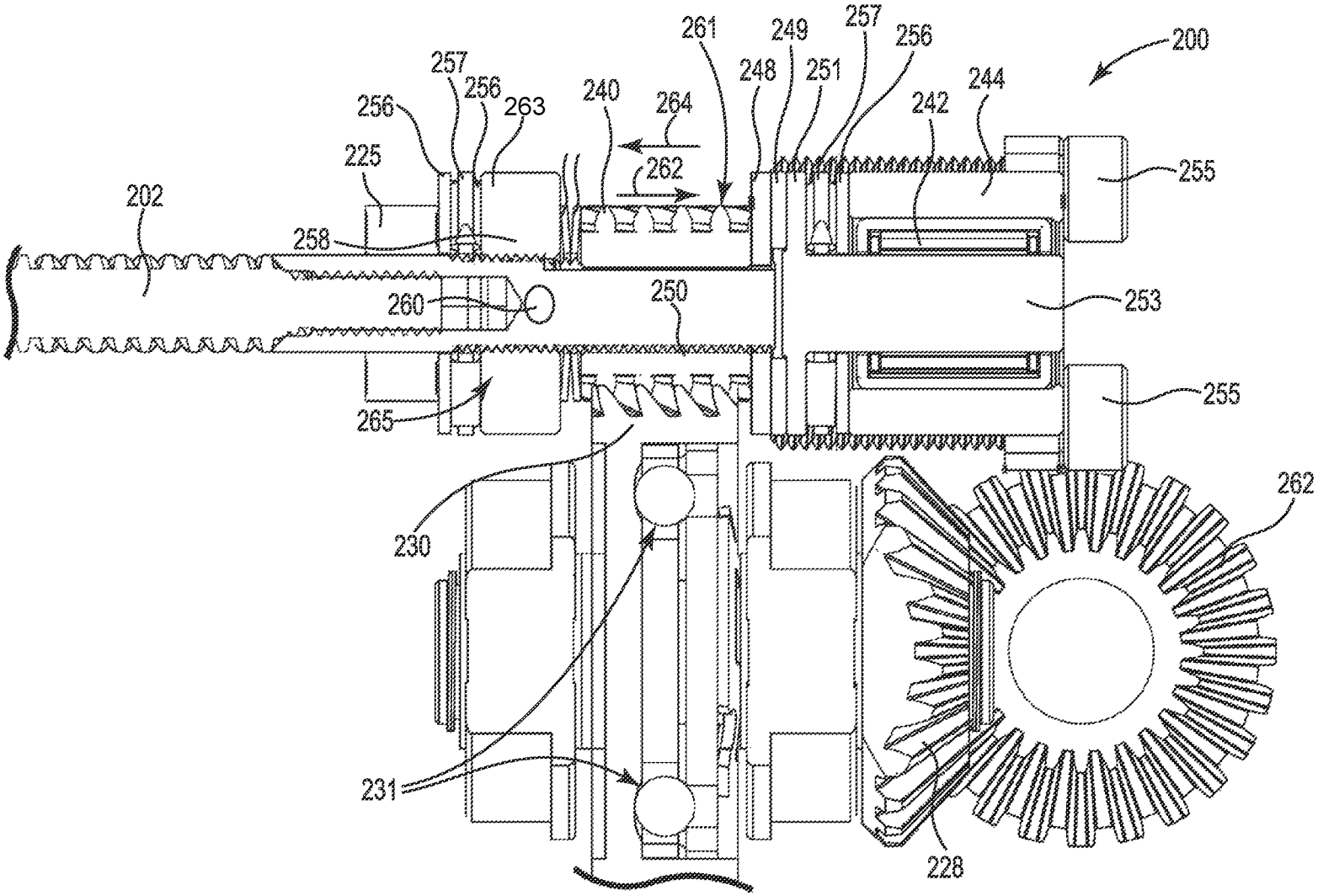
Figure 14:
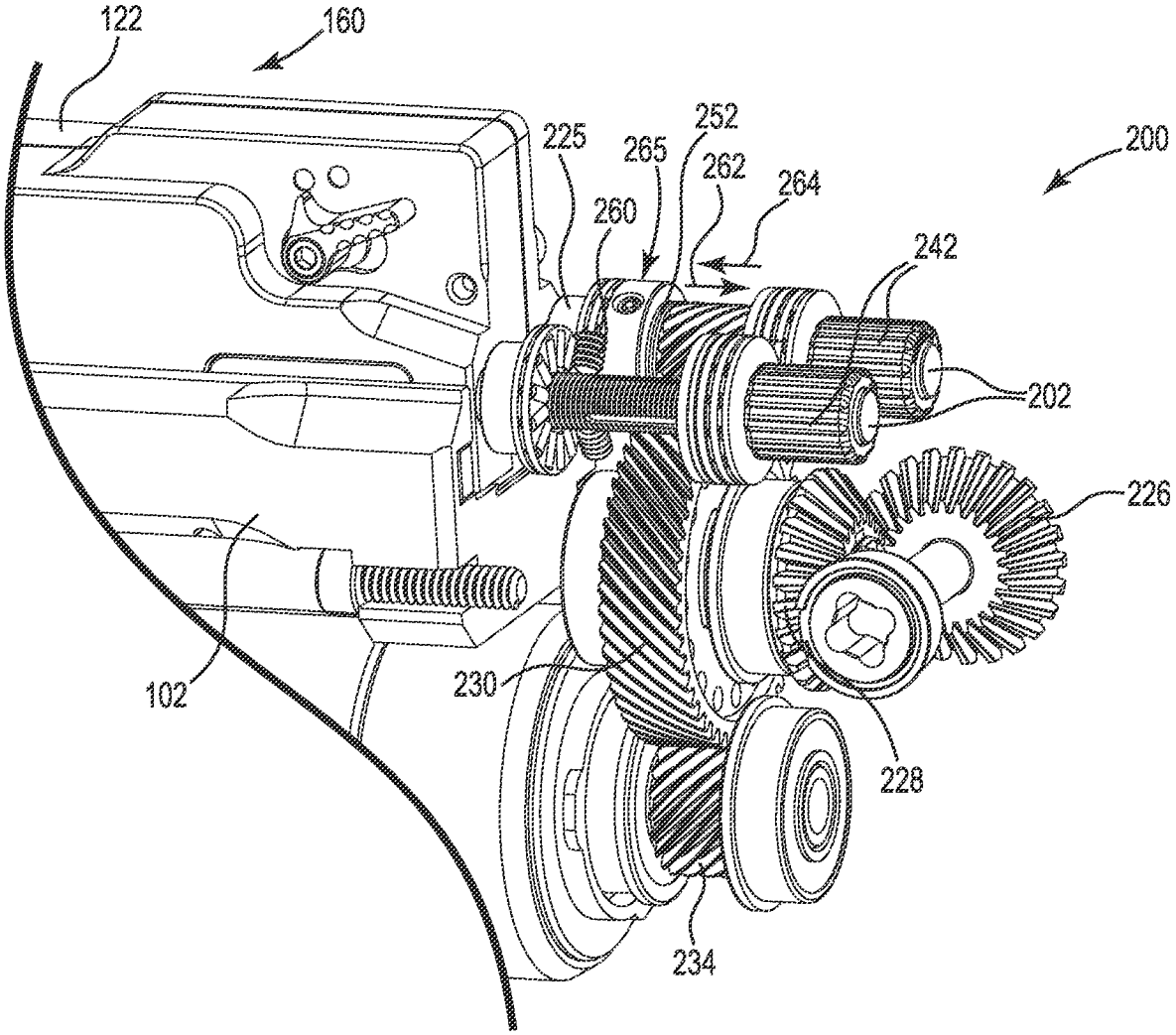

FIGS. 13 and 14 illustrate the cocking system 200 with selected components hidden to best illustrate operation. Moving from left to right, bearings 225 supports the screw shafts 202 radially, but do not restrict axial movement of the screw shafts 202. Thrust washers 256 used in conjunction with thrust needle bearings 257 provide low friction bearing for axial loads. Timing mechanisms 265 include screw shims 263 and a plurality of cut-outs 258 of varying depth that selectively engage with pins 260 extending through the screw shafts 202 and bear axial loads. The screw shims 263 can be rotated during assembly of the crossbow 100 to engage with a different cut-out 258 to synchronize the timing of the screw shafts 202.

A pair of Belleville springs 259 are located between the screw shims 263 and spiral gears 240. The screw shaft keys 250 provide radial coupling between the spiral gears 240 and the screw shafts 202. The screw shaft keys 250 permit axial movement of the spiral gears 240 relative to the screw shafts 202. The spring force of the Belleville springs 259 serve to bias the spiral gears 240 rearward in a direction 262 toward brake washers 248. The brake washers 248 are radially coupled to the screw shafts 202 by the screw shaft keys 250 so as to permit axial movement.

Friction washers 249 are interposed between the brake washers 248 and brake discs 251. The friction washers 249 provide friction torque between the brake washers 248 and the brake discs 251 when radial displacement occurs between the same. Portions 253 of the brake discs 251 are coupled to one-way bearings 242, which are secured in sleeves 244. The thrust needle bearings 257 and friction washers 249 are located between the sleeves 244 and the brake discs 251 provide low friction bearing for axial loads on the brake discs 251.

The Belleville springs 259, the spiral gears 240, the brake washers 248, the friction washers 249, and the brake disc 251 may operate as a mechanical clutch 261. The mechanical clutch 261 decouples the one-way bearings 242 from the spiral gears 240 to permit opposite rotation of the screw shafts 202 so the string carrier 122 can be moved toward the distal end 106 of the crossbow 100.

The one-way bearings 242 permit free rotation of the brake discs 251 in the cocking direction only, but prevents any rotation of the brake discs 251 in the de-cocking direction. Adjustment screws 255 compress the sleeve 244 against the stack (251, 249, 248, 240) to adjust the preload on the Belleville washers 252 as a means of presetting brake torque.

When cocking the crossbow 100 the one-way bearings 242 turn freely. When in the drawn configuration 136, the one-way bearings 242 and brake discs 251 impart sufficient friction to the screw shafts 202 to retain the string carrier 122 in the retracted position 160, notwithstanding the force applied by the draw string 132 and the limbs 120. No other mechanism is required to retain the string carrier 122 in the retracted position 160 (or anywhere along the length of the center rail 102). If the user releases the cocking handle at any time during cocking or de-cocking of the crossbow 100, the one-way bearings 242 and friction between the brake discs 251 and the brake washers 248 is sufficient to retain the cocking system 200 in its current position.

In the event the user wishes to manually de-cock the crossbow 100, force applied to the cocking handle rotates the intermediate spiral gear 230 in the opposite direction.

The angled teeth on the spiral gear 230 apply an axial force on the mating angled teeth of the spiral gears 240, creating an axial force on the spiral gears 240 in opposite direction 264 which compresses the Belleville springs 259. Shifting the spiral gears 240 in the opposite direction 264 reduces or eliminates the fiction between the brake discs 251 and the brake washers 248 by a sufficient amount to permit the screw shafts 202 to rotate in the opposite direction, de-cocking the crossbow 100. In another embodiment, the mechanical clutch 261 can be manually decoupled, such as with a release lever, such as the cocking system release disclosed in U.S. Pat. No. 10,209,026 (previously incorporated by reference). It will be appreciated that the present cocking system 200 may be used with virtually any crossbow, including without limitation the crossbows disclosed in U.S. Pat. No. 10,209,026.

The present cocking system 200 is highly repeatable, increasing the accuracy of the crossbow 100. By contrast, conventional cocking ropes, cocking sleds and hand-cocking techniques lack the repeatability of the string carrier 122, resulting in reduced accuracy. Windage and elevation adjustments cannot adequately compensate for random variability introduced by prior art cocking mechanisms.

Figure 15:
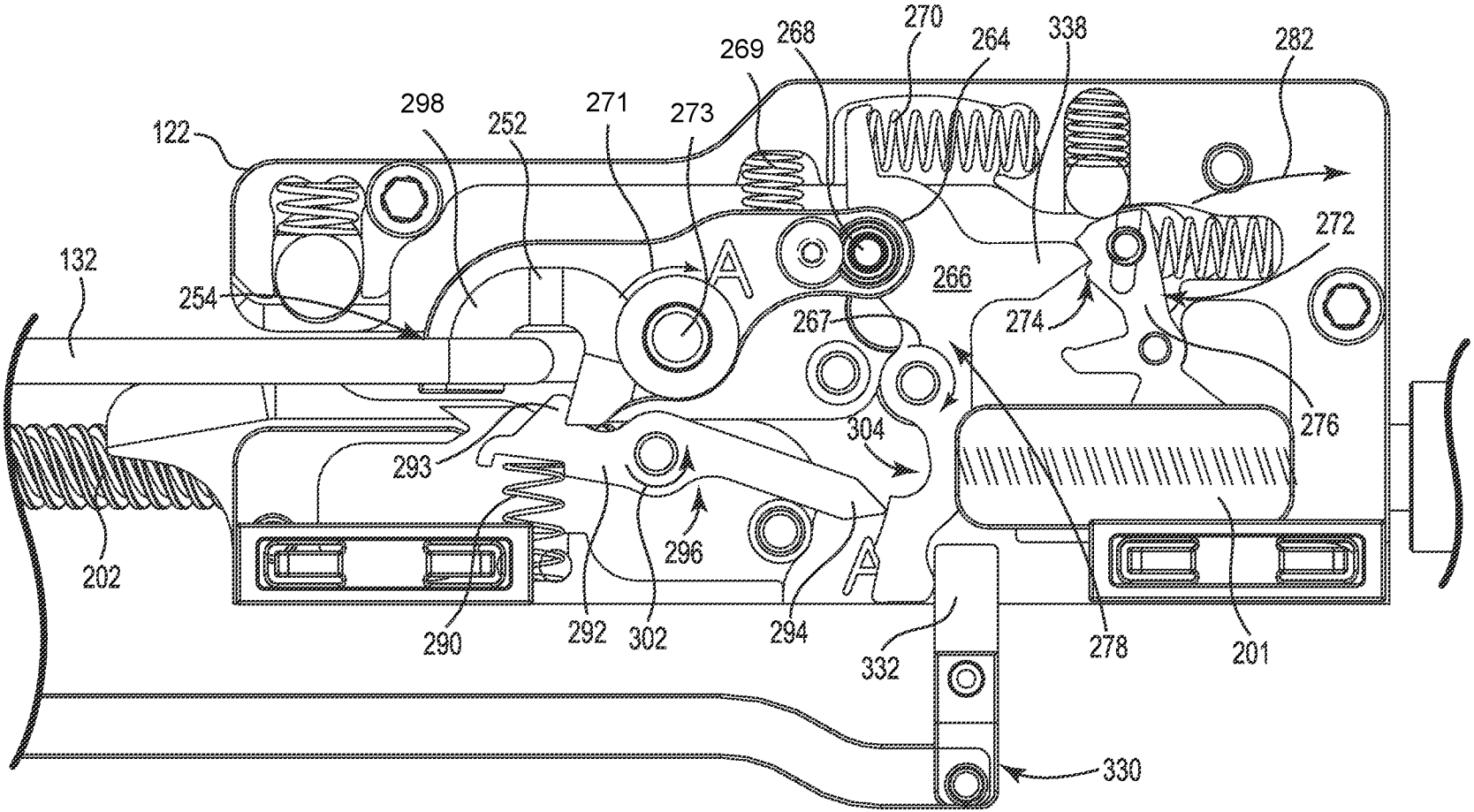
FIG. 15 is a side view of an example trigger system for a crossbow in accordance with an embodiment of the present disclosure.

FIG. 15 illustrates operation of the string carrier 122 for the crossbow 100 in accordance with an embodiment of the present disclosure. The string carrier 122 includes catch 252 with fingers 298 that engage the draw string 132. The catch 252 is illustrated in a closed position 254. Spring 269 applies a biasing force to rotate the catch 252 in a direction 271 around a pin 273 and retains the catch 252 in the open position. Absent an external force, the catch 252 automatically moves to the open position and releases the draw string 132. As used herein, "closed position" refers to any configuration that retains a draw string in a drawn configuration and "open position" refers to any configuration that releases the draw string.

In the closed position 254 illustrated in FIG. 15, a recess 275 on a sear 266 engages a low friction device 268 at rear edge of the catch 252 to retain the catch 252 in the closed position 254. The sear 266 is biased into engagement with the catch 252 by a spring 270.

When safety 276 is in a safe position 272, a shoulder 274 on the safety 276 engaged with an extension 338 of the sear 266, and retains the sear 266 in a cocked position 278 and the catch 252 in the closed position 254. A safety button 280 is used to move the safety 276 in a direction 282 from the safe position 272 to a free position with the shoulder 274 disengaged from the sear 266.

A spring 290 applies a biasing force to bias the dry fire lockout 292 toward the catch 252. A distal end 294 of the dry fire lockout 292 engages the sear 266 in a lockout position 296 to prevent the sear 266 from releasing the catch 252. Even if the safety 276 is disengaged from the sear 266, the distal end 294 of the dry fire lockout 292 retains the sear 266 in the cocked position 278 to prevent the catch 252 from releasing the draw string 132.

In the illustrated embodiment, the portion 293 on the dry fire lockout 292 is positioned behind the draw string 132. As used herein, the phrase "behind the draw string" refers to a region between a draw string and a proximal end of a crossbow. Conventional flat or half-moon nocks do not extend far enough rearward to reach the portion 293 of the dry fire lockout 292, reducing the chance that non-approved arrows can be launched by the crossbow 100.

When the nock of the arrow 118 engages with the draw string 132, the dry fire lockout 292 is rotated in the direction 302. A distal end 294 of the dry fire lockout 292 disengaged from the sear is positioned in a location 304 relative to the sear 266. Once the safety 276 is removed from the safe position 272, the crossbow 100 may be fired. In the preferred embodiment, the nock is a clip-on version that flexes to form a snap-fit engagement with the draw string 132. In some instances, when the arrow 118 is fully engaged with the draw string 132 will the dry fire lockout 292 be in the disengaged position that permits the sear 266 to release the catch 252. Suitable materials and other aspects of the nock 300 are disclosed in U.S. Pat. No. 10,203,186 (Yehle) and U.S. Pat. No. 10,139,205 (Yehle), the entire of which are hereby incorporated by reference.

Trigger assembly 330 is mounted in the center rail 102, separate from the string carrier 122. Only when the string carrier 122 is in the retracted position 160 is the trigger pawl 332 positioned adjacent to the sear 266. When the trigger 340 (see FIG. 4) is depressed the sear 266 is rotated in a clockwise direction 267 to a de-cocked position and the catch 252 moves to the open position to release the draw string 132.

After firing the crossbow, the catch 252 retains the sear 266 in the de-cocked position even though the spring 270 biases it toward the cocked position 278 (see FIG. 15). In the de-cocked position, the location 304 on the sear 266 engages with the dry fire lockout 292 to retain it in a disengaged position even though the spring 290 biases it toward the lockout position 296 of FIG. 15.

To cock the crossbow 100, again the string carrier 122 is moved forward into engagement with the draw string 132. Lower edge of the catch 252 engages the draw string 132 and overcomes the force of spring 269 to automatically push the catch 252 to the closed position 254. The spring 270 automatically rotates the sear 266 back into the cocked position 278 so the recess 275 on the sear 266 forms an interface with the catch 252. Rotation of the sear 266 causes the extension 338 to slide along the surface of the safety 276 until it engages with the shoulder 274 in the safe position 272. With the sear 266 back in the cocked position 278, the spring 290 biases dry fire lockout 292 to the lockout position 296 so the distal end 294 engages the sear 266 to prevent the catch 252 from releasing the draw string 132 until an arrow is inserted into the string carrier 122. Consequently, when the string carrier 122 is pushed into engagement with the draw string 132, the draw string 132 pushes the catch 252 from the open position to the closed position 254 to automatically (i) couple the sear 266 with the catch 252 to retain the catch 252 in the closed position 254, (ii) move the safety 276 to the safe position 272 to retain the sear 266 in the cocked position 278, and (iii) move the dry fire lockout 292 to the lockout position 296 to block the sear 266 from moving to the de-cocked position.

Figure 16A:
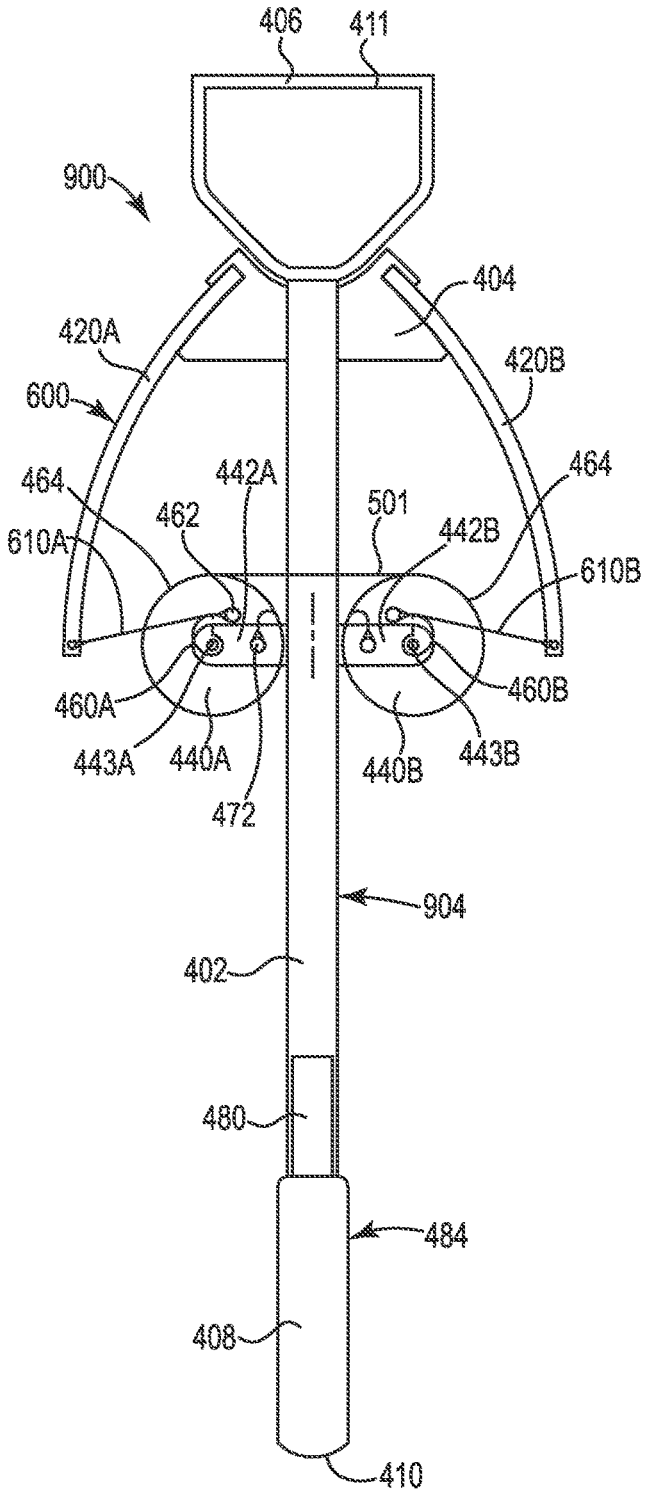
FIGS. 16A-16C illustrate an example crossbow in which pulleys rotate around axes in a fixed relationship relative to a center rail and a riser in accordance with an embodiment of the present disclosure.
Figure 16B:
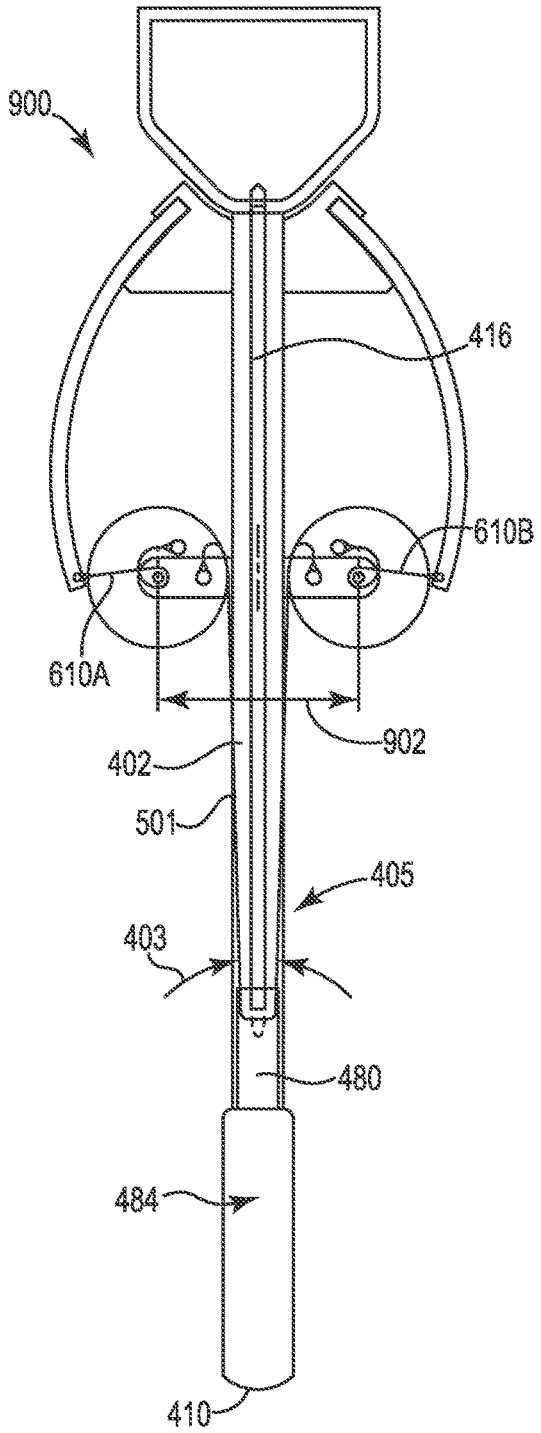

FIGS. 16A and 16B illustrate an alternate crossbow 900 in accordance with an embodiment of the present disclosure. FIG. 16A illustrates the crossbow 900 in the released configuration 600 and FIG. 16B illustrates the drawn configuration 405. The various components of the crossbow 900 are shown in more detail in U.S. Pat. No. 10,209,206 (Yehle), which is hereby incorporated by reference.

The crossbow 900 includes a center rail 402 with a riser 404 mounted at a distal end 406 and a stock 408 located at a proximal end 410. The center rail 402 and the riser 404 may be referred to herein as a frame 904. The riser 404 includes a pair of limbs 420A, 420B ("420") extending rearward toward the proximal end 410.

Cams 440A, 440B are attached to the frame 904, rather than the limbs 420. In the illustrated embodiment, the cams 440 are attached to the center rail 402 by axle mounts 442A, 442B. The cams 440 rotate around axes 443A, 443B ("443") on respective axle mounts 442A, 442B, but otherwise may not move relative to the frame 904. The locations of axes 443 are fixed relative to the center rail 402 and the riser 404, even as the limbs 420 and the draw string 501 move. Consequently, energy stored in the limbs 420 when the crossbow 900 is in the drawn configuration 405 is not diverted to accelerating the mass of the cams 440, resulting in greater energy transferred to the arrow 416. The cams 440 and axle mounts 442 may also eliminate any inaccuracies introduced by moving the cams 440 with the limbs 420 when firing a conventional crossbow.

Draw string 501 is engaged with draw string journals 464 (see e.g., FIG. 15 of U.S. Pat. No. 10,209,206) in a reverse draw configuration. Ends of the draw string 501 are preferably attached to the cams 440 at draw string mounts 472. The crossbow 900 may also be configured in a non-reverse draw configuration.

Power cables 610A, 610B are attached to the limbs 420A, 420B, respectively. Opposite ends of the power cables 610 are attached to the power cable attachments 462 on the cams 440. The cams 440 include power cable journals 460A, 460B that receive respective power cables 610A, 610B as the draw string 510 is moved from the released configuration 600 to the drawn configuration 405. In some instances, the power cable journals 460A, 460B are helical journals.

In the preferred embodiment, each limb 420 includes upper and lower power cables 610 that engaged with upper and lower power cable journals 460 on the cams 440 (see e.g., FIG. 15 of U.S. Pat. No. 10,209,206). In one embodiment, the power cable journals 460 are the upper and lower helical journals 460A, 460B located above and below draw string journal 464. The helical journals 460A, 460B preferably move the power cables 610A, 610B in directions 468A, 468B, respectively, away from the plane 466 as the crossbow 400 is drawn.

Draw string 501 is preferably retracted to the drawn configuration 405 shown in FIG. 16B using the string carrier 480. As discussed herein, the string carrier 480 slides along the center rail 402 toward the riser 404 to engage the draw string 501 while it is in a released configuration 600. The string carrier 480 is moved to the retracted position by cocking system 484. The crossbow 900 may use the cocking system 200 disclosed herein or any of the cocking systems disclosed in U.S. Pat. No. 10,209,206. Foot stirrup 411 permits the user to secure the crossbow 900 while using the alternate cocking systems 800.

The axes 443 preferably have a fixed separation 902 of between about 3 inches to about 8 inches, and more preferably, about 4 inches. The drawn configuration 405 illustrated in FIG. 16B results in an included angle 403 of the draw string 501. The included angle 403 is preferably less than about 15 degrees, and more preferably less than about 10 degrees. The power stroke is preferably about 12 inches to about 16 inches.

In the drawn configuration 405 of FIG. 16B the draw string 501 is close to the center rail 402. In one embodiment the draw string 501 in entirely contained within the center rail 402 in the drawn configuration 405. In another embodiment, the draw string 501 is substantially surrounded by a string guard and/or the center rail 402 when in the drawn configuration 405 (see e.g., FIG. 4). Consequently, the user is shielded from the entire string path traversed by the draw string 501 between the drawn configuration 405 and the released configuration 600.

Figure 16C:
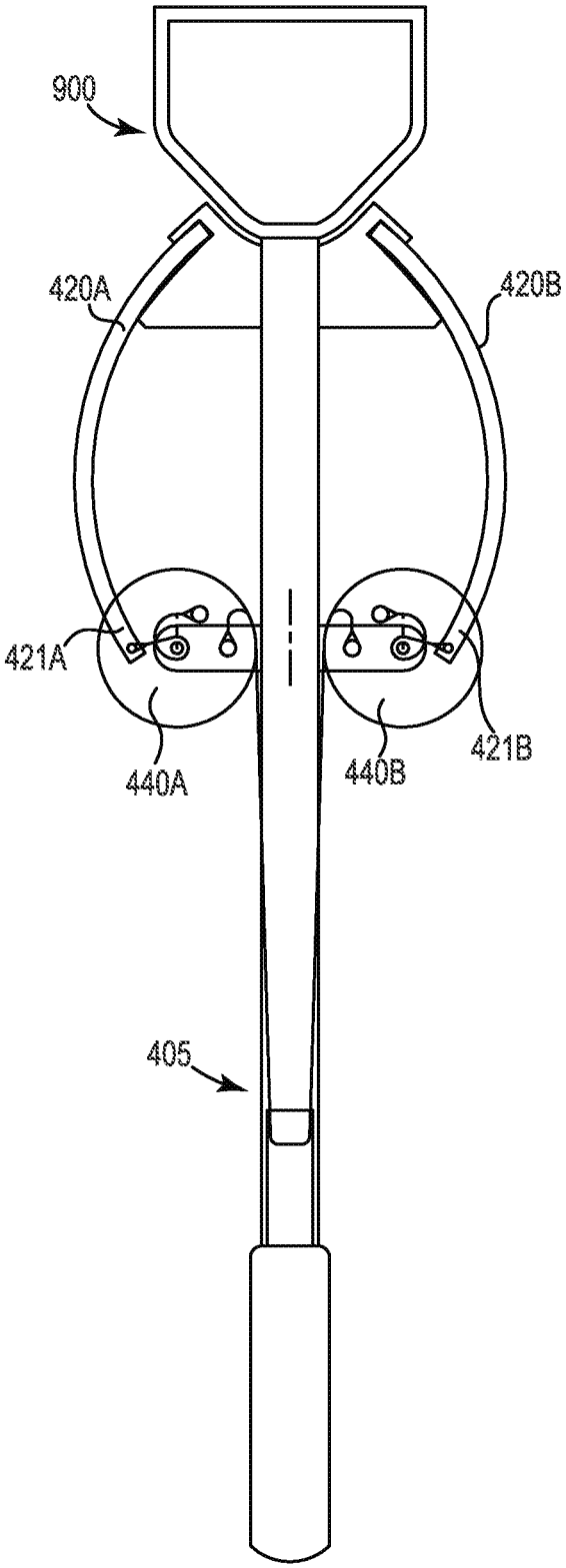

FIG. 16C illustrates an alternate version of the crossbow 900 with limb tips 421A, 421B ("421") that overlap with cams 440A, 440B, respectively, in accordance with an embodiment of the present disclosure. The overlap of the limb tips 421 with the cams 440 is best seen from the top or rear of the crossbow 900. In one embodiment, the limb 420A is a pair of upper and lower limbs with a pair of limb tips 421A that are positioned above and below the cam 440A when in the drawn configuration 405. Similarly, the limb 420B includes a pair of upper and lower limbs with a pair of limb tips 421B that are positioned above and below the cam 440B when in the drawn configuration 405. Configuring the limb tips 421 to overlap the cams 440 permits the crossbow 900 to be more compact in the drawn configuration 405.

Figure 17C:
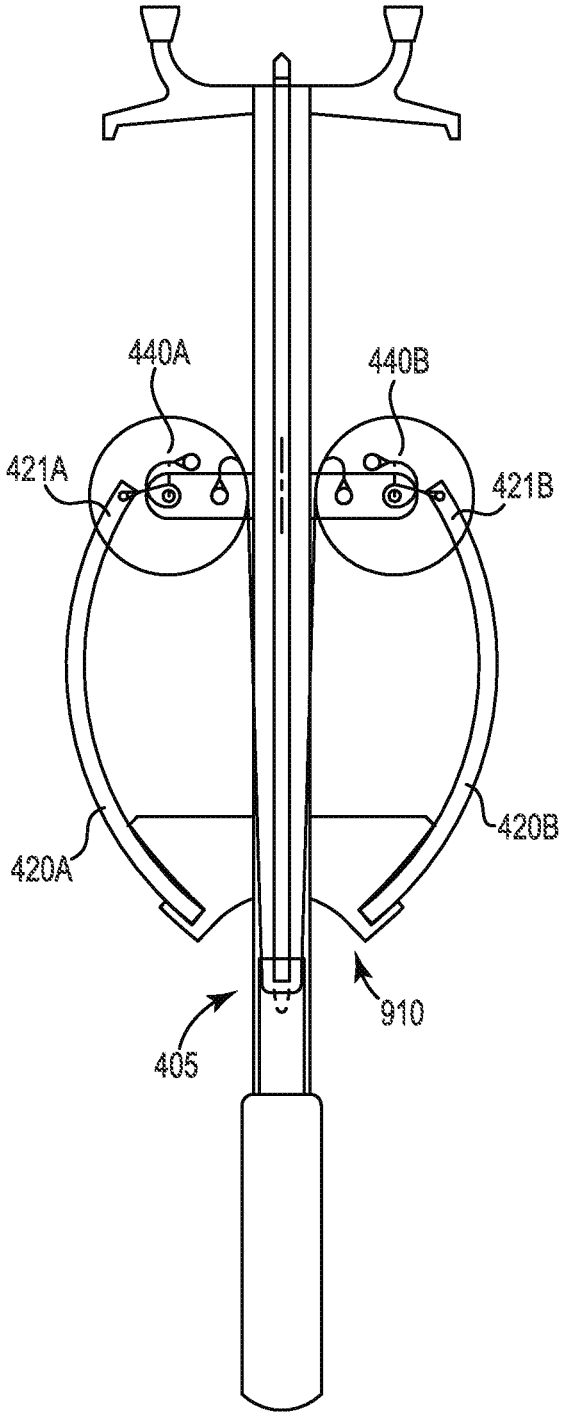
FIGS. 17A-17C illustrate a variation of the crossbow of FIGS. 16A-16C with limbs swept forward in accordance with an embedment of the present disclosure.
Figure 17A:
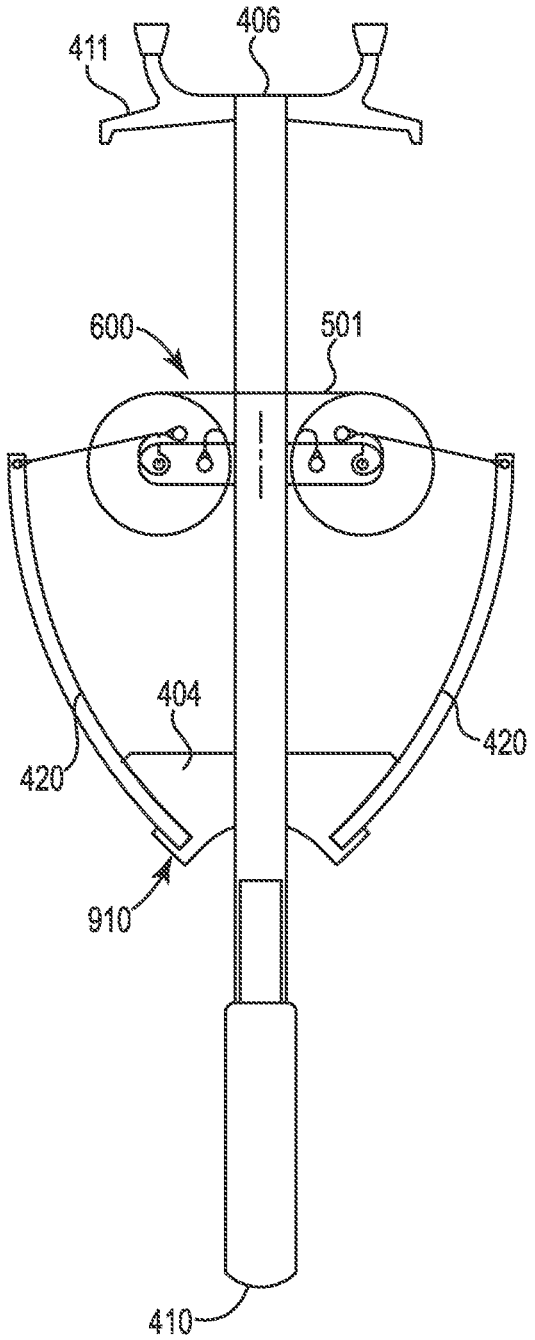
Figure 17B:
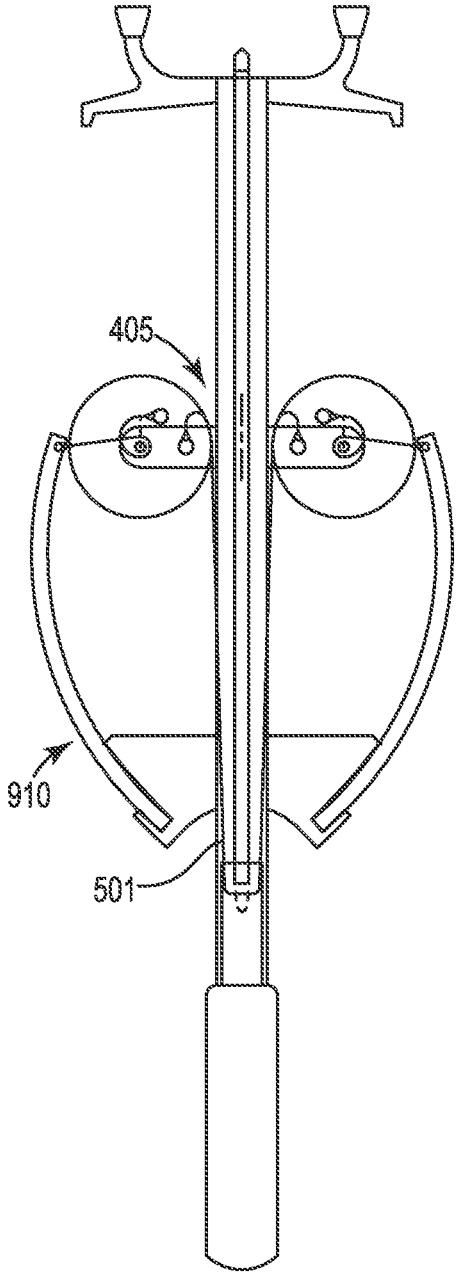

FIGS. 17A and 17B illustrate an alternate crossbow 910 with forward swept limbs 420 in accordance with an embodiment of the present disclosure. The crossbow 910 is substantially the same as the crossbow 900, except that the riser 404 is located closer to the proximal end 410 and the limbs 420 extending forward toward the distal end 406. A variation of the foot stirrup 411 is also illustrated. The draw string 501 is arranged in a reverse draw configuration, with the released configuration illustrated in FIG. 17A and the drawn configuration illustrated in FIG. 17B.

FIG. 17C illustrates an alternate version of the crossbow 910 with limb tips 421A, 421B ("421") that overlap with cams 440A, 440B, respectively, in accordance with an embodiment of the present disclosure. The overlap of the limb tips 421 with the cams 440 is best seen from the top or rear of the crossbow 900. Overlap or overlapping refers to the limb tip being located above and/or below the cams 440 within the outside perimeter of the cams 440. In one embodiment, the limb 420A is a pair of upper and lower limbs with a pair of limb tips 421A that are positioned above and below the cam 440A when in the drawn configuration 405. Similarly, the limb 420B includes a pair of upper and lower limbs with a pair of limb tips 421B that are positioned above and below the cam 440B when in the drawn configuration 405. Configuring the limb tips 421 to overlap the cams 440 permits the crossbow 900 to be more compact in the drawn configuration 405.

Figure 18:
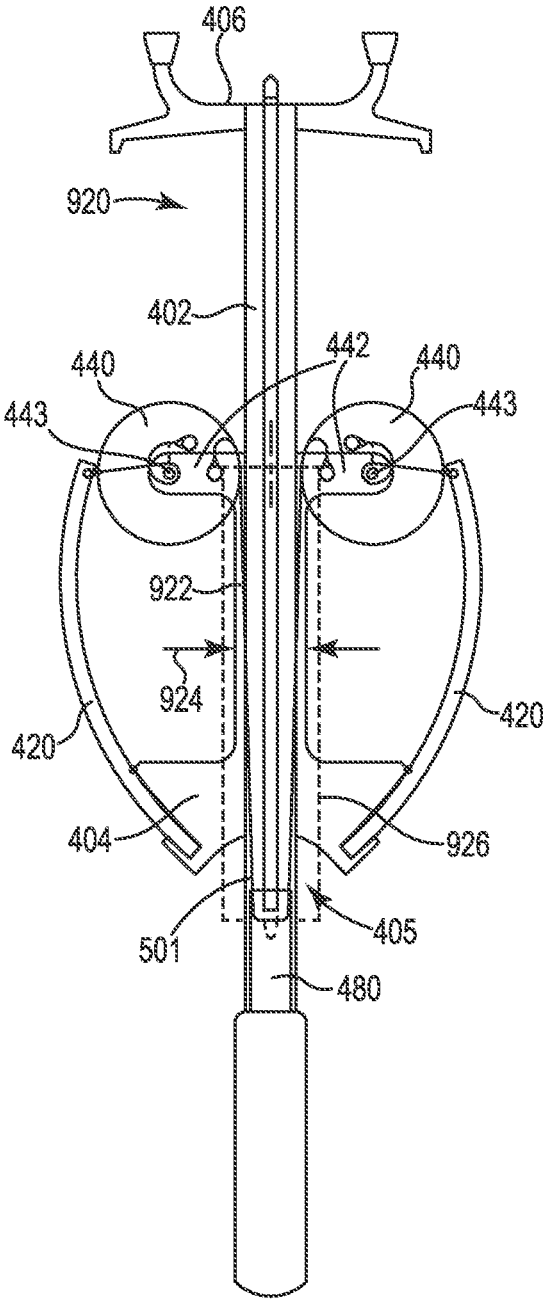
FIG. 18 illustrates an example crossbow in which pulleys rotate around axes attached to a riser in accordance with an embodiment of the present disclosure.

FIG. 18 illustrates another alternate crossbow 920 with the cams 440 attached to the riser 404 in accordance with an embodiment of the present disclosure. The crossbow 920 is substantially the same as the crossbow 900 except that the limbs 420 extending forward toward the distal end 406.

The riser 404 extends along the center rail 402 to provide attachment locations for both the limbs 420 and the cams 440. The cams 440 are attached to the riser 404 closer to the distal end 406 and rotate around axes 443. In one embodiment, the axle mounts 442 are machined directly into the riser 404. Alternatively, the axle mounts 442 are discrete components attached to the riser 404.

Center portions 922 of the riser 404 have a width 924 greater than the draw string 501 when in the drawn configuration 405 as illustrated in FIG. 18. String guard 926 extending over the top of the crossbow 920 is optionally added to partially or fully enclose the draw string 501. The string carrier 480 may also move within the string guard 926. Consequently, the entire string path traversed by the draw string 501 between the drawn configuration 405 and the released configuration 600 is optionally isolated from the user.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. A cocking system for a crossbow that has at least a first flexible limb attached to a riser and second flexible limb attached to the riser, and a draw string that translates along a center rail of the crossbow between a released configuration and a drawn configuration, the cocking system comprising:

a string carrier received by the center rail, the string carrier being configured to translate along a center axis of the crossbow between a first position to engage with the draw string when the draw string is in the released configuration, and a second position to move the draw string to the drawn configuration;

at least one screw shaft attached to the center rail and engaged with the string carrier, wherein rotation of the at least one screw shaft about a first axis translates the string carrier along the center axis between the first position and the second position, wherein the first axis is parallel with the center axis;

a cocking handle support axle perpendicular to the first axis;

a one-way bearing rotatable about the first axis and engaged coaxially with the at least one screw shaft, the one-way bearing being configured to:

permit rotation of the at least one screw shaft in a retracting direction in response to a rotation of the cocking handle support axle in a first direction to move the string carrier to the second position, and inhibit rotation of the at least one screw shaft in an extending direction such that the string carrier is retained in a current location along the center rail during a release of the cocking handle support axle; and a mechanical clutch including:

a gear coaxial with the first axis and configured to rotate about the first axis and translate along the first axis;

a spring coaxial with the first axis and positioned at least partially between the gear and a thrust surface;

a brake washer engaged with the gear and engaged coaxially with the at least one screw shaft;

a brake disc coupled to the one-way bearing and coaxial with the first axis; and a friction washer coaxial with the first axis and positioned axially between the brake washer and the brake disc, wherein the spring is configured to bias the gear in a first axial direction along the first axis, wherein the gear is configured to translate along the first axis in a second axial direction along the first axis opposite the first axial direction to compress the spring between the thrust surface and the gear to selectively disengage the one-way bearing from the at least one screw shaft to permit rotation of the at least one screw shaft in the extending direction, wherein the string carrier is configured to move to the first position when the cocking handle support axle is rotated in a second direction opposite the first direction, wherein the one-way bearing is configured to permit rotation of the brake disc in the retracting direction, and inhibit rotation of the brake disc in the extending direction, wherein the friction washer is configured to provide friction between the brake washer and the brake disc, and wherein translating the gear in the second direction reduces the friction between the brake washer and the brake disc to permit the at least one screw shaft to rotate in the extending direction.

2. The cocking system of claim 1, wherein:

the string carrier includes:

a catch movable between a closed position that engages the draw string and an open position that releases the draw string, a sear moveable between a cocked position to retain the catch in the closed position and a de-cocked position that releases the catch to the open position, and a safety moveable between a free position and a safe position that inhibits the catch from moving to the open position; and the crossbow further includes a trigger attached to the center rail that selectively releases the draw string from the string carrier while the string carrier is in the second position.

3. The cocking system of claim 1, further comprising a cover that substantially encloses the draw string as the draw string translates between the released configuration and the drawn configuration.

4. The cocking system of claim 1, wherein:

a first portion of the draw string is engaged with a first cam attached to the riser; and a second portion of the draw string is engaged with a second cam attached to the riser.

5. The cocking system of claim 1, wherein the at least one screw shaft comprises:

a first screw shaft attached to the center rail, the first screw shaft disposed along a first side of the center rail and below the center axis; and a second screw shaft attached to the center rail, the second screw shaft disposed along a second side of the center rail and below the center axis.

6. The cocking system of claim 1, wherein the spring is coaxial with the at least one screw shaft and the one-way bearing about the first axis and parallel with the center axis.

7. The cocking system of claim 1, wherein the cocking handle support axle is engaged with a first bevel gear rotatable about the cocking handle support axle, and wherein the first bevel gear is engaged with a second bevel gear rotatable about a second axis that is perpendicular to the cocking handle support axle.

8. The cocking system of claim 7, wherein, in response to rotation of the cocking handle support axle in the first direction, rotation of the first bevel gear and the second bevel gear, the gear compresses the spring between the thrust surface and the gear.

9. The cocking system of claim 1, wherein, during operation of the crossbow, the gear compresses the spring along the first axis between the thrust surface and the gear.

10. The cocking system of claim 1, wherein the gear includes gear teeth structured to engage with an intermediate gear such that rotation of the intermediate gear rotates the gear and biases the gear along the first axis to compress the spring along the first axis between the thrust surface and the gear.

11. The cocking system of claim 10, wherein:

the at least one screw shaft includes:

a first screw shaft attached to the center rail, the first screw shaft disposed along a first side of the center rail and below the center axis, and a second screw shaft attached to the center rail, the second screw shaft disposed along a second side of the center rail and below the center axis;

the one-way bearing is a first one-way bearing engaged coaxially with the first screw shaft, and the cocking system includes a second one-way bearing engaged coaxially with the second screw shaft; and the mechanical clutch is a first mechanical clutch engaged coaxially with the first screw shaft, and the cocking system includes a second mechanical clutch engaged coaxially with the second screw shaft.

12. The cocking system of claim 11, wherein the intermediate gear is engaged with both the gear of the first mechanical clutch and a second gear of the second mechanical clutch.

13. The cocking system of claim 1, wherein the string carrier is configured to support a projectile, wherein the projectile is configured to be positioned along the center axis and suspended over at least a portion of the center rail, wherein the projectile is further configured to be supported by an arrow rest coupled with the center rail, the arrow rest including a rotatable member configured to engage with the projectile.

14. The cocking system of claim 13, wherein the rotatable member is spring loaded in a direction toward the center axis.

15. The cocking system of claim 1, wherein the gear is positioned rearward relative to the spring along the first axis, and wherein the one-way bearing is positioned rearward relative to the gear along the first axis.

16. A method of cocking a crossbow, comprising:

engaging a string carrier of the crossbow with a draw string of the crossbow; and rotating a screw shaft of the crossbow about a first axis in a first direction to translate the string carrier along a center axis of the crossbow from a first position in which the crossbow is in a released configuration to a second position in which the crossbow is in a drawn configuration, wherein:

the first axis is parallel with the center axis;

the screw shaft is restricted from rotating in a second direction via a one-way bearing that engages with the screw shaft in instances where rotation of the screw shaft in the first direction is ceased, the one-way bearing being coaxial with the screw shaft and rotatable about the first axis;

the screw shaft is permitted to rotate in the second direction in instances where a clutch is actuated to disengage the one-way bearing and the screw shaft;

the clutch includes:

a gear coaxial with the first axis and configured to rotate about the first axis and translate along the first axis;

a spring coaxial with the first axis and positioned at least partially between the gear and a thrust surface;

a brake washer engaged with the gear and engaged coaxially with the screw shaft;

a brake disc coupled to the one-way bearing and coaxial with the first axis; and a friction washer coaxial with the first axis and positioned axially between the brake washer and the brake disc, wherein the one-way bearing is configured to permit rotation of the brake disc in a retracting direction, and inhibit rotation of the brake disc in an extending direction, wherein the friction washer is configured to provide friction between the brake washer and the brake disc, and wherein translating the gear in the second direction reduces the friction between the brake washer and the brake disc to permit the screw shaft to rotate in the extending direction; and the clutch is actuated to disengage the one-way bearing and the screw shaft responsive to the gear translating along the first axis to compress the spring.

17. The method of cocking the crossbow of claim 16, wherein rotating the screw shaft comprises rotating a cocking handle support axle mechanically coupled to the screw shaft, wherein the cocking handle support axle is perpendicular to the first axis and the center axis.

18. The method of cocking the crossbow of claim 16, wherein the draw string is retained at least partially within a cover as the string carrier translates from the first position to the second position.

* * * * *